US006094556A

United States Patent [19]

Tanaka et al.

[11] Patent Number: 6,094,556

[45] Date of Patent: Jul. 25, 2000

[54] INTERMEDIATE TRANSFER MEMBER AND IMAGE FORMING APPARATUS

[75] Inventors: Atsushi Tanaka, Susono; Minoru Shimojo, Kawasaki; Akira Shimada, Shizuoka-ken; Hiroyuki Osada, Numazu; Tsunenori Ashibe, Yokohama; Hidekazu Matsuda, Numazu, all of Japan

[73] Assignee: Canon Kabushiki Kaisha, Tokyo, Japan

[21] Appl. No.: 09/239,021

[22] Filed: Jan. 29, 1999

[30] Foreign Application Priority Data

Jan. 29, 1998 [JP] Japan ..... 10-016778
Jan. 13, 1999 [JP] Japan ..... 11-006938

[51] Int. Cl.[7] ..... G03G 15/01

[52] U.S. Cl. ..... 399/302; 399/308

[58] Field of Search ..... 399/101, 297, 399/302, 308; 430/126

[56] References Cited

U.S. PATENT DOCUMENTS 5,298,956 3/1994 Mammino et al. ..... 399/308
5,589,921 12/1996 Markies et al. ..... 399/297
5,608,503 3/1997 Fujiwara et al. ..... 399/302
5,745,831 4/1998 Nakazawa et al. ..... 399/308
5,794,111 8/1998 Tombs et al. ..... 399/302

FOREIGN PATENT DOCUMENTS 187968 11/1983 Japan .
301960 12/1988 Japan .
9085 1/1992 Japan .
271142 10/1995 Japan .
262952 10/1996 Japan .

*Primary Examiner*—Robert Beatty
*Attorney, Agent, or Firm*—Fitzpatrick, Cella, Harper & Scinto

[57] ABSTRACT

An intermediate transfer member for receiving a toner image formed on a first image-bearing member and transferring the toner image onto a second image-bearing member has a surface coated with at least one of a nitrate ion adsorbent and a compound having a layer structure, whereby a scattering of toner particles during a successive image formation is effectively suppressed for a long period.

41 Claims, 14 Drawing Sheets

INTERMEDIATE TRANSFER MEMBER AND IMAGE FORMING APPARATUS

FIELD OF THE INVENTION AND RELATED ART

The present invention relates to an intermediate transfer member for use in an image forming apparatus using electrophotography, particularly an intermediate transfer member for temporarily receiving a toner image formed on a first image-bearing member (primary transfer) and transferring the toner image held on the intermediate transfer member onto a second image-bearing member (secondary transfer), and an image forming apparatus using the intermediate transfer member.

An image forming apparatus using an intermediate transfer member is advantageous than an image forming apparatus wherein a toner image is transferred from a first image-bearing member onto a second image-bearing member attracted by a transfer drum as described in Japanese Laid-Open Patent Application (JP-A) 63-301960 since the image forming apparatus (using the intermediate transfer member) does not necessitate processing or control of a transfer(-receiving) material (as the second image-bearing member), e.g., gripping by a gripper, attracting, providing a curvature, etc. As a result, it is possible to transfer the toner image onto a wide variety of materials, including thin paper (40 $g/m^2$) to thick paper (200 $g/m^2$), wide to narrow medium, and long to short medium, thus allowing transfer onto an envelope, a post card and a label paper.

Because of such an advantage, color copying machines and color printers using intermediate transfer members having already been available on the market.

In the image forming apparatus using the intermediate transfer member, it is necessary to effect transfer two times (primary and secondary transfers), therefore the image forming apparatus has been required heretofore to provide an improved transfer efficiency.

In order to solve this problem, there have been proposed some methods. For example, JP-A 58-187968 proposes application of an organic fluorine-containing compound onto a surface of an intermediate transfer member. JP-A 4-9085 proposes application of silicone oil onto the intermediate transfer member surface. Further, JP-A 7-271142 and JP-A 8-262952 propose application of zinc stearate or zinc oleate onto the intermediate transfer member surface.

However, these image forming apparatus using such intermediate transfer members improve a resultant transfer efficiency to a certain degree but are accompanied with a scattering of toner particles primary-transferred onto the intermediate transfer member at the surface of the intermediate transfer member during the primary transfer and the secondary transfer when subjected to successive or continuous image formation, thus gradually deteriorating resultant image qualities.

SUMMARY OF THE INVENTION

An object of the present invention is to provide an intermediate transfer member little causing a scattering of toner particles even when repeatedly used for a long period.

Another object of the present invention is to provide an image forming apparatus using the intermediate transfer member.

According to the present invention, there is provided an intermediate transfer member for receiving a toner image formed on a first image-bearing member and transferring the toner image onto a second image-bearing member, having a surface provided with at least one of a nitrate ion adsorbent and a compound having a layer structure.

According to the present invention, there is also provided an image forming apparatus, comprising: a first image-bearing member, and an intermediate transfer member for receiving a toner image formed on the first image-bearing member and transferring the toner image onto a second image-bearing member, wherein the intermediate transfer member has a surface provided with at least one of a nitrate ion adsorbent and a compound having a layer structure.

According to the present invention, there is further provided an image forming apparatus, comprising: a first image-bearing member, and an intermediate transfer member for receiving a toner image formed on the first image-bearing member and transferring the toner image onto a second image-bearing member, and application means for supplying at least one of a nitrate ion adsorbent and a compound having a layer structure onto a surface of the intermediate transfer member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The intermediate transfer member according to the present invention is characterized by its surface provided with at least one of a nitrate ion adsorbent and a compound having a layer structure (hereinafter, referred to as a "layer-structure compound").

These substance and compound are effective in suppressing an occurrence of a scattering of toner particles on the surface of the intermediate transfer member.

We pressure that the scattering of toner particles is caused through the following mechanism.

Figure 2:
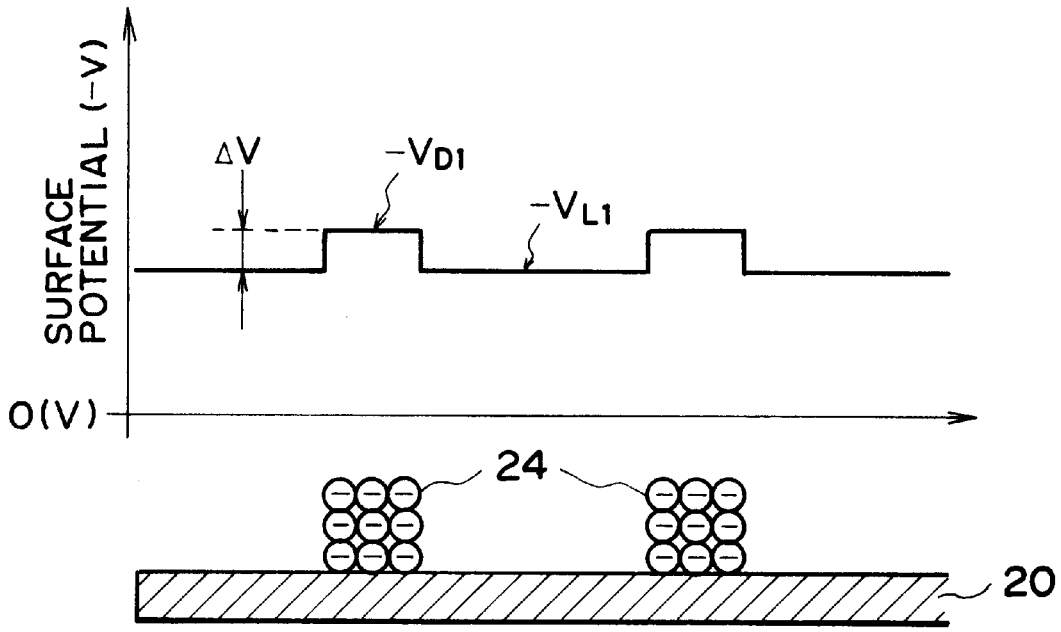
FIGS. 2 and 3 are illustrations of surface potential distributions of an intermediate transfer member immediately after primary transfer and immediately before secondary transfer, respectively.
Figure 3:
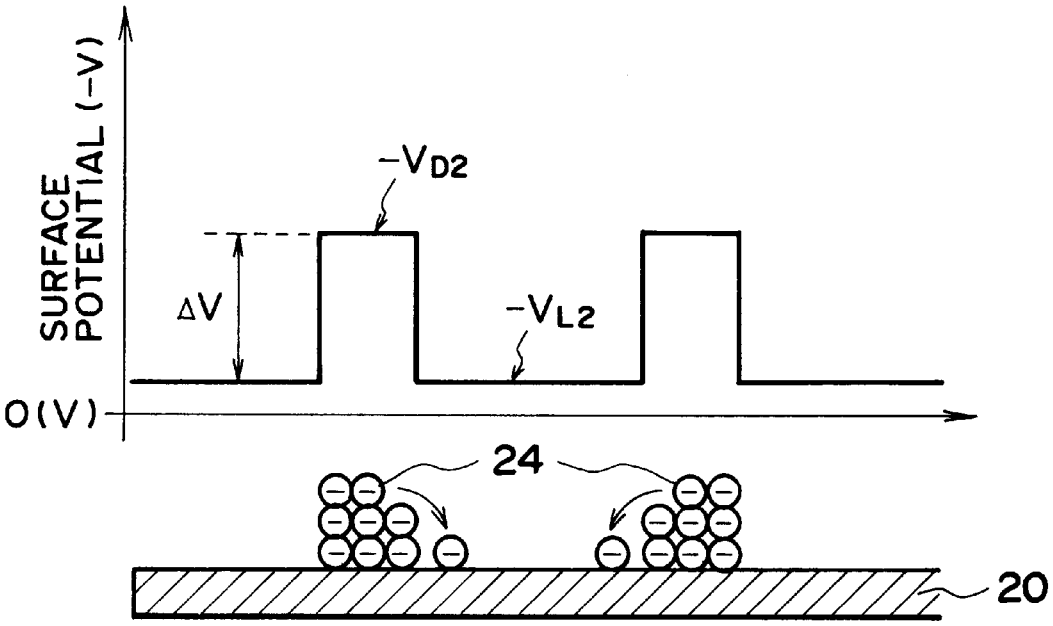

FIG. 2 shows a state (suppositional view) of a surface potential distribution of intermediate transfer member (intermediate transfer belt) 20 carrying thereon negatively-charged toner particles 24 immediately after primary transfer (from a first image-bearing member) and FIG. 3 shows that immediately before second transfer (onto a second image-baring member). Further, a photosensitive member used is (electrically) charged negatively.

Referring to FIG. 2, immediately after the primary transfer, an image portion of the intermediate transfer member (where toner particles primary-transferred from the first image bearing member are present) has a surface potential $-V_{D1}$ (V (volt)) due to charges of the toner particles per se. On the other hand, a non-image portion of the intermediate transfer member (where the primary-transferred toner particles are not present) has a surface potential of $-V_{L1}$ (V) due to charges carried from the photosensitive member during the primary transfer (i.e., a primary transfer current).

In the state shown in FIG. 2, the surface potentials $-V_{D1}$ and $-V_{L1}$ generally have a substantially identical value (i.e., $|-V_{D1}| \fallingdotseq |-V_{L1}|$). Even if absolute values of the potentials $-V_{D1}$ and $-V_{L1}$ provide a difference therebetween, the difference may be at most 100 (V) (i.e., $|-V_{D1}|-|-V_{L1}| \leqq 100$).

FIG. 3 shows the state of a surface potential distribution of the intermediate transfer member 20 immediately before secondary transfer as described above.

Referring to FIG. 3, a surface potential $-V_{D2}$ (V) at the image portion is considered to be substantially equal to $-V_{D1}$ (V) since a charge attenuation of toner particles per se is slow. On the other hand, a surface potential $-V_{L2}$ (V) at the non-image portion is largely affected by an electrical resistance of the intermediate transfer member. Specifically, when the intermediate transfer member has a low electrical resistance, the surface potential $-V_{L2}$ (V) at the non-image portion is largely attenuated as shown in FIG. 3, thus resulting in $0\ (V) \fallingdotseq |-V_{L2}\ (V)| << |-V_{L1}\ (V)|$).

Consequently, a potential difference $\Delta V$ between the image portion and the non-image portion becomes large as shown in FIG. 3, so that a part of the toner particles 24 having the negative charge is moved along the lines of electric force produced by the potential difference $\Delta V$ to cause a scattering of the toner particles 24.

Accordingly, an increase in electrical resistance of the intermediate transfer member thereby to provide a slow attenuation of the charges of toner particles at the non-image portion is effective in preventing the scattering.

However, when the electrical resistance is set too high, the primary transfer current does not flow, thus failing to effect the primary transfer per se. In view of this difficulty, there has been proposed an intermediate transfer member comprising a plurality of layers including a surface layer having a high electrical resistance (e.g., at least $1\times10^{14}$ ohm.cm) and a small thickness (e.g., 5–100 $\mu$m).

In such an intermediate transfer member, however, it is possible to obtain good images with less scattering at an initial stage but a degree of the scattering is gradually increased during a successive image formation, thus leading to inferior toner images.

As a result of our study on a state of the intermediate transfer member after the successive image formation, the intermediate transfer member has been found to have an electrical resistance being ca. 1/10 of that at the initial stage. Further, as a result of surface analysis of the intermediate transfer member (after the successive image formation), a nitrate ion ($NO_3^-$) has been detected at the intermediate transfer member surface. There has not been detected the nitrate ion thereat, so that the mechanism of a deterioration of the scattering due to the successive image formation may be considered as follows.

Ozone is generated by discharge caused during the successive image formation (e.g., at the time of the primary and secondary transfers) and reacts with nitrogen within an ambient air to form nitrogen oxides (NOx). The nitrogen oxides react with moisture in the ambient air to form nitric acid. The thus formed nitric acid is electrolytically dissociated (ionized) into hydrogen ion ($H^+$) and nitrate ion ($NO_3^-$). As the image formation proceeds, the hydrogen ion ($H^+$) and the nitrate ion ($NO_3^-$) are attached to the surface of the intermediate transfer member, thus resulting in a decrease in electric resistance of the intermediate transfer member. For this reason, when the successive image formation is performed, the surface potential difference $\Delta V$ between the image portion potential and the non-image portion potential of the intermediate transfer member becomes large as shown in FIG. 3, thus increasing the degree of scattering of toner particles.

According to the above-mentioned toner scattering mechanism, a removal of the nitrate ion (generated during the successive image formation) is considered to be effective in suppressing the toner particle scattering.

Accordingly, in the present invention, by providing a nitrate ion adsorbent to the surface of the intermediate transfer member, it is possible to adsorb the nitrate ion generated during the successive image formation, thus preventing an increase in the nitrate ion which moves freely along the intermediate transfer member surface and causes a decrease in its electrical resistance. As a result, it becomes possible to suppress a decrease in electrical resistance of the intermediate transfer member thereby to prevent the toner particle scattering.

Herein, the nitrate ion adsorbent refers to a substance having a nitrate ion ($NO_3^-$)-adsorbing property. Specifically, the nitrate ion adsorbent means a substance having a total nitrogen concentration (as a nitrate ion adsorption factor or parameter) of 13 (mg/l) when measured in the following manner.

Measurement of Nitrogen Concentration

Apparatus: Multi-item water quality meter ("Model LASA-1" mfd. by Toa Denpa Kogyo K.K.)

Reagent: 2,6-dimethylphenol (trade name "LCK339", mfd. by Toa Denpa Kogyo K.K.)

Filter: LPZ-284 (330 nm, mfd. by Toa Denpa Kogyo K.K.)

Procedure:

1. 0.5 g of a sample substance is added in 10 ml of an aqueous nitric acid solution ($1\times10^{-3}$ N), followed by stirring (or shaking) for 40 min.

2. In the case where the resultant mixture is turbid, the turbid mixture is filtered by an appropriate filter means to recover a filtrate.

3. In a cuvette ("LCK238", mfd. by Toa Denpa Kogyo K.K.), 0.5 ml of the filtrate (or the sample solution) is added and then 0.2 ml of a reagent (2,6-dimethylphenol; "LCK339") is added, followed by plugging (with a stopper) and shaking for a prescribed time.

Thereafter, the cuvette is left standing for 15 min. at room temperature (20–25° C.) and the total nitrogen concentration is measured according to an instruction manual of the apparatus (LASA-1) (program item=NO3-N) to determine a nitrogen concentration (mg/l) of the sample substance.

In the present invention, the nitrate ion adsorbent may preferably have a nitrogen concentration of at most 10 (mg/l), more preferably at most 7 (mg/l), further preferably at most 5 (mg/l), in order to achieve a larger scattering-prevention effect.

Examples of the nitrate ion absorbent used in the present invention may include: magnesium silicate; aluminum silicate; magnesium oxide; magnesium hydroxide; magnesium carbonate; aluminum-magnesium hydroxide; co-precipitated aluminum hydroxide and sodium bicarbonate (dawsonite); hydroxyaluminum-aminoacetate, co-precipitated aluminum hydroxide, magnesium carbonate and calcium carbonate; and anion exchangers (ion exchangers having an anion exchange capacity, including those having primary to quaternary amino (or ammonium) groups, such as dialkylaminoethyl group, trimethylhydroxypropylamino group, and triethanolamino group).

The nitrate ion adsorbent preferably be subjected to surface treatment, such as hydrophobicity-imparting treatment since an electrical resistance of the surface-treated nitrate ion adsorbent per se is not readily affected by humidity to further effectively suppress a lowering in electrical resistance of the intermediate transfer member in a high-humidity environment, thus resulting in toner images with less toner particle scattering irrespective of humidity.

Such a surface-treated nitrate ion adsorbent, however, has a low affinity or compatibility with the nitric acid solution (i.e., has a high hydrophobicity), thus having a nitrogen concentration 13 (mg/l) in some cases when measured through the above-mentioned manner. However, this does not mean a lowering in nitrate ion adsorption capacity of the nitrate ion adsorbent since the higher nitrogen concentration value in this case merely means a lowering in an adsorption speed of nitrate ion in the nitrogen concentration measurement and does not affect the scattering prevention effect of toner particles.

Accordingly, the above-mentioned surface-treated nitrate ion adsorbent having a nitrogen concentration above 13 (mg/l) is also inclusively used as the nitrate ion adsorbent in the present invention so long as a nitrate ion adsorbent before effecting the surface (hydrophobicity-imparting) treatment has a nitrogen concentration of at most 13 (mg/l).

Examples of an agent for the surface treatment may include higher fatty acid (such as stearic acid, oleic acid or lauric acid), a surfactant (such as sodium stearate or sodium laurylbenzene-sulfonate), a coupling agent (such as vinylethoxysilane, hexamethylenedisilazane or isopropyltridecylbenzenesulfonyltitanate), and glycerin aliphatic acid ester (such as glycerol monostearate or glycerol mono-oleate). Of these surface treating agents, higher fatty acid may particularly preferably be used.

In the present invention, it is also possible to provide (attach) a compound having a layer structure (layer-structure compound) onto the intermediate transfer member surface since the layer-structure compound incorporates nitrate ion between adjacent layers to prevent a lowering in electrical resistance of the intermediate transfer member surface, thus suppression the toner particle scattering during the successive image formation.

In the present invention, the "layer structure" means a crystalline structure wherein atoms or atomic groups are substantially disposed in a set of parallel planes or sheets between which relatively vacant regions are present and a relatively weak force (e.g., van der Waals force) is exerted. The atoms and atomic groups constituting each of the planes are relatively strongly connected to each other, e.g., covalent bonding.

Examples of the layer-structure compound may include kaolin, mica and a hydrotalcite-type compound.

As a preferred example of layer-structure compound, it is possible to employ a hydrotalcite-type compound represented by the following formula (1):

$$M^{2+}_{(1-x)}M^{3+}_{x}(OH)_2A^{n-}_{(x/n)}\cdot mH_2O \quad (1),$$

wherein $M^{2+}$ denotes a divalent metal ion; $M^{3+}$ denotes a trivalent metal ion; $A^{n-}$ denotes an anion having a valence of n; X denotes a molar fraction and $0<X\leqq0.5$; and $m\geqq0$.

The hydrotalcite-type compound of the formula (1) comprises a layer-structure compound consisting of a positively-charged base layer ($[M^{2+}_{(1-x)}M^{3+}_{x}(OH)_2]^{x+}$) and a negatively charged intermediate layer ($[A^{n-}_{(x/n)}\cdot mH_2O]^{x-}$), thus being regarded as an intercalation compound wherein the intermediate layer is sandwiched between adjacent base layers.

The anion ($A^{n-}$) present in the intermediate layer of the hydrotalcite-type compound of the formula (1) is readily substituted or exchanged with nitrate ion ($NO_3^-$) (anion exchange reaction).

A mechanism of the anion exchange reaction has not been clarified but may be attributable to an action of a combination of an electrical interaction (attractive force) between the (positive) base layer and the nitrate ion, a size of a void or spacing (thickness) for the intermediate layer, and a physical adsorptivity.

The hydrotalcite-type compound of the formula (1) adsorb the nitrate ion according to the following reaction formula (i):

$$M^{2+}_{(1-x)}M^{3+}_{(x)}(OH)_2A^{n-}_{(x/n)}\cdot mH_2O+xHNO_3\rightarrow M^{2+}_{(1-x)}M^{3}+_{(x)}(OH)_2(NO_3)_x\cdot mH_2O+H_xA^{n-}_{(x/n)}.$$

Accordingly, it is possible to achieve the scattering prevention effect of toner particles in the successive image formation by providing the hydrotalcite-type compound onto the surface of the intermediate transfer member.

In addition, the hydrotalcite-type compound is insoluble in water and retains the water-insoluble property even after the nitrate ion adsorption, so that the compound is not electrically dissociated to lower the electrical resistance of the intermediate transfer member, thus further enhancing the toner particle scattering for a long period.

The hydrotalcite-type compound is also considered to have an adsorptivity to NOx gas (nitrogen oxides) and thus is considered to be very effective in suppressing the toner particle scattering due to a synergistic effect such that formation of nitrate ion per se is suppressed by the NOx gas adsorptivity in addition to inactivation of nitrate ion by the anion exchange reaction.

In the above-mentioned formula (1), the molar fraction X of $M^{3+}$ ($0<X\leqq 0.5$) may preferably be in the range of $0.2\leqq X$ ($\leqq 0.5$), particularly $0.25\leqq X$ ($\leqq 0.5$) in view of the scattering prevention effect since there has been known that a nitrate ion adsorption capacity (anion exchange capacity) is enhanced with a larger molar fraction X. In view of a stability of a crystal structure, the molar fraction X may preferably be in the range of $0<X\leqq 1/3$ (0.33) since mutual positive charge repulsion between lattice points where $M^{3+}$ is substituted by $M^{2+}$ may presumably become stronger.

In the present invention, it has also been found that the hydrotalcite-type compound of the formula (1) provides a further improved scattering prevention effect when the compound has an anion $A^{n-}$ providing a conjugate acid $HA^{(n-1)}$ having an electrolytic dissociation exponent for acid pKa of at least 3.

This is presumably because the hydrotalcite-type compound of the formula (1) forms an acid as a result of the anion exchange reaction. At that time, when the thus formed acid has a pKa=at last 3, a proportion of (electrolytic) dissociation for $HA^{(n-1)-}$ being a conjugate acid of $A^{n-}$ becomes very small. As a result, an amount of isolated anion on the right side of the reaction formula (i) (after the anion exchange) is decreased when compared with that on the left side (before the anion exchange). Specifically, the hydrotalcite-type compound of the formula (1) having the anion $A^{n-}$ providing a pKa=at least 3 as the acid dissociation exponent of its conjugate acid $HA_{(n-1)-}$ not only adsorbs the nitrate ion on the intermediate transfer member surface but also more effectively prevent a lowering in electrical resistance of the intermediate transfer member during the successive image formation because an absolute amount of the isolated anion $A^{n-}$ dissociated from the hydrotalcite-type compound as a result of the anion exchange, thus suppressing the toner particle scattering.

Strictly speaking, the reaction formula represents a chemical equilibrium state. Accordingly, when the amount of $A^{n-}$ is increased with increased nitric acid adsorption, the reaction formula (1) does not readily proceed to the right side, so that the resultant nitrate ion adsorptivity is expected to be lowered. However, if the pKa is at least 3, an amount of the formed $A^{n-}$ is very small, thus not hindering the anion exchange reaction of the formula (i) toward the right side. As a result, the hydrotalcite-type compound (providing pKa=at least 3) has an advantage of exhibiting the scattering prevention effect even when a small amount thereof is present at the surface of the intermediate transfer member.

The anion $A^{n-}$ in the formula (1) described above may be any anion so long as its conjugate acid $HA^{(n-1)-}$ has a pKa of at least 3.

Examples of $A^{n-}$ may include: $OH^-$ (pKa=7.0 for $H_2O$), $CO_3^{2-}$ (pKa for $HCO_3^-$ (pK2 for $H_2CO_3$)=10.33), $HC_3^-$ (pKa (pK1) for $H_2CO_3$=6.35), $CH_3COO^-$ (pKa for $CH_3COOH$=4.76), $ClO^-$ (pKa for HClO=7.53), $F^-$ (pKa for HF=3.46), $PO_4^{3-}$ (pKa for $HPO_4^{2-}$ (pK3 for $H_3PO_4$)=12.36), $HPO_4^{2-}$ (pKa for $H_2PO_4^-$ (pK2 for $H_3PO_4$)=7.20), $H_2CO_3^-$ (pKa (pK1) for $H_3CO_3$=9.24), $C_2O_4^{2-}$ (pKa for $H_2O_4^-$ (pK2 for $H_2C_2O_4$=4.29), $HCOO^-$ (pKa for HCOOH=3.75), $C_2H_5COO^-$ (pKa for $C_2H_5COOH$=4.9), $SO_3^{2-}$ (pKa for $HSO_3^-$ (pK2 for $H_2SO_4$)=7.18), $PHO_3^{2-}$ (pKa for $HPHO_3^-$ (pK2 for $H_2PHO_3$)=6.79), $HS^-$ (pKa (pK1) for $H_2S$=7.02), $S^{2-}$ (pKa for $HS^-$ (pK2 for $H_2S$)=13.9) and (tartrate ion)$^{2-}$ (pKa for tartrate ion)$^-$ (pK2 for tartaric acid)=4.44). These anions may be used singly or in combination of two or more species (e.g., $CO_3^{2-}$ and $CH_3COO^-$).

The anion $A^{n-}$ may preferably be used when its conjugate acid $HA^{(n-1)-}$ has a pKa of at least 4, particularly at least 6.

Further, the anion $A^{n-}$ (providing pKa=at least 3 for its conjugate acid) may be used in combination with another anion (providing pKa below 3 for its conjugate acid) when it is used in an amount of at least 20 mol. %, preferably at least 50 mol. %, based on a total amount of the entire anions.

Examples of another anion may include: $SO_4^{2-}$ (pKa for $HSO_4^-$ (pK2 for $H_2SO_4$)=1.99), (salicylate ion)$^-$ (pKa (pK1) for salicylic acid=2.81), (citrate ion)$^-$ (pKa (pK1) for citric acid=2.87) and (tartrate ion)$^-$ (pKa (pK1) for tartaric acid=2.99).

When the hydrotalcite-type compound of the formula (1) has carbonate ion ($CO_3^{2-}$) as the anion $A^{n-}$, the compound forms water and carbon dioxide (gas) through the following reaction formula (ii):

$$M^{2+}_{(1-x)}M^{3+}_{x}(OH)_2CO_3^{2-}{}_{(x/2)}\cdot mH_2O+xHNO_3 \rightarrow M^{2+}_{(1x)}M^{3+}_{x}(OH)_2(NO_3^-)_x\cdot mH_2O+(x/2)H_2O+(x/2)CO_2$$

The carbon dioxide thus generate is gas, so that it does not lower the electrical resistance of the intermediate transfer member. Strictly speaking, a very small amount of the carbon dioxide is dissolved in water to form carbonic acid ($H_2CO_3$) but the carbonic acid ha a larger pK2 of 10.33, so that the carbonate ion ($CO_3^{2-}$) is little formed. In addition, the hydrotalcite-type compound has a property such that it has a low selectivity as to the carbonate ion, so that such a small amount of carbonate ion does not adversely affect the anion exchange reaction of the formula (ii) toward the right side. Further, the hydrotalcite-type compound having the carbonate ion ($CO_3^{2-}$) as the anion $A^{n-}$ is industrially mass-produced, thus being available inexpensively. Accordingly, in the present invention, the carbonate ion may be used as a particularly preferred anion for $A^{n-}$.

In the above mentioned formula (1), specific examples of the divalent metal ion $M^{2+}$ may include: $Mg^{2+}$, $Ca^{2+}$, $Sr^{2+}$, $Ba^{2+}$, $Zn^{2+}$, $Ni^{2+}$, $Cd^{2+}$, $Sn^{2+}$, $Pb^{2+}$, $Fe^{2+}$ and $Cu^{2+}$, and those of the trivalent metal ion $M^{3+}$ may include $In^{3+}$, $Sb^{3+}$, $B^{3+}$ and $Ti^{3+}$. These cations ($M^{2+}$ and $M^{3+}$) may be used singly or in combination of two or more species and may also be used in combination with other cations having a valence of 1 or at least 4.

Of the above specific cations for $M^{2+}$ and $M^{3+}$, in view of industrial and inexpensive availability, $Mg^{2+}$ and $Al^{3+}$ may preferably be used as $M^{2+}$ and $M^{3+}$, respectively.

As described above, a preferred compound as the hydrotalcite-type compound of the formula (1) is represented by the following formula (2):

$$Mg_{(1-x)}Al_x(OH)_2(CO_3)_{x/2}\cdot mH_2O \quad (2),$$

wherein $0<X\leqq 0.5$ and $m\geqq 0$.

Specific examples of the compound of the formula (2) may include:

1. $Mg_{0.68}Al_{0.32}(OH)_2(CO_3)_{0.16}0.57H_2O$
2. $Mg_{0.8}Al_{0.2}(OH)_2(CO_3)_{0.1}0.61H_2O$
3. $Mg_{0.75}Al_{0.25}(OH)_2(CO_3)_{0.125}.0.5H_2O$
4. $Mg_{0.83}Al_{0.17}(OH)_2(CO_3)_{0.085}.0.47H_2O$

The compound of the formula (2) may further contain a small amount (e.g., at most 0.1 as a (total) molar fraction) of cations other than $Mg^{2+}$ and $Al^{3+}$, such as $H^+$, $Li^+$, $Na^+$, $K^+$, $Ag^+$, $Cu^+$, $Ca^{2+}$, $Sr^{2+}$, $Ba^{2+}$, $Zn^{2+}$, $Ni^{2+}$, $Cd^{2+}$, $Sn^{2+}$, $Pb^{2+}$, $Fe^{2+}$, $Cu^{2+}$, $Fe^{3+}$, $Co^{3+}$, $Bi^{3+}$, $In^{3+}$, $Sb^{3+}$, $B^{3+}$, and $Ti^{3+}$, and a small amount of anions other than $CO_3^{2-}$, without impairing the scattering prevention effect.

Even if such other cations and/or anions are used in a total molar fraction above 0.1, respectively, the resultant hydrotalcite-type compound does not substantially adversely affect the scattering prevention effect, thus being sufficient usable in the present invention as the compound falling under the definition of the formula (1).

A preferred example of the layer-structure compound may be a lithium aluminate-type compound represented by the following formula (3):

$$Li_{(1-x)}M^{2+}{}_{x}M^{3+}{}_{2}(OH)_{6}A^{n-}{}_{((1+x)/n)}\cdot mH_2O \quad (3),$$

wherein $M^{2+}$ denotes a divalent metal ion, $M^{3+}$ denotes a trivalent metal ion, $A^{n-}$ denotes an anion having a valency of n where n is an integer of at least 1, X denotes a molar fraction, $0<X\leqq 0.5$ and $m\geqq 0$.

Similarly as in the above-mentioned hydrotalcite-type compound, the lithium aluminate-type compound of the formula (3) also has an anion exchange ability and is effective in inactivating nitrate ion through the following reaction formula (iii) with nitric acid:

$$Li_{1-x}M^{2+}{}_{x}M^{3+}{}_{2}(OH)_{6}A^{n-}{}_{((1+x)/n)}\cdot mH_2O+(1+x)HNO_3 \rightarrow Li_{(1-x)}M^{2+}{}_{x}M^{3+}{}_{2}(OH)_{6}(NO_3)_{(1+x)}\cdot mH_2O+H_{(1+x)}A^{n-}{}_{((1+x)/n)}$$

As a result of our study on the lithium aluminate-type compound of the formula (3), it has been confirmed that the compound is also excellent in the scattering prevention effect.

Further, similarly as in the hydrotalcite-type compounds of the formulas (1) and (2), the lithium aluminate-type compound of the formula (3) may preferably have the anion $A^{n-}$ providing a pKa=at least 3 for its conjugate acid and may further contain other ions (impurities) in a small amount without impairing the scattering prevention effect.

As another preferred compound for the layer-structure compound, it is also possible to employ a compound represented by the following formula (4):

$$M^{2+}{}_{(1-x)}M^{3}+{}_{x}O_{(1+x/2)}\cdot mH_2O \quad (4),$$

wherein $M^{2+}$ denotes a divalent metal ion, $M^{3+}$ denotes a trivalent metal ion, X denotes a molar fraction, $0<X\leqq 0.5$, and $m\geqq 0$.

The compound of the formula (4) may be obtainable from the above-mentioned hydrotalicite-type compound of the formula (1).

Specifically, when the compound of the formula (1) is heated at high temperature (300–800° C.), OH, $A^{n-}$ and $H_2O$ are eliminated therefrom, a resultant compound has a compositional formula: $M^{2+}{}_{(1-x)}M^{3+}{}_{x}O_{(1+x/2)}$. Thereafter, the resultant compound can incorporate therein intercalation water, thus resulting in a compound of the formula (4).

The above elimination reaction is a reversible reaction and the compound of the formula (4) inactivates nitrate ion through the reaction with nitric acid and water according to the following reaction formula (iv):

$$M^{2+}{}_{(1-x)}M^{3+}xO_{(1+x/2)}\cdot xHNO_3+zH_2O \rightarrow M^{2+}{}_{(1-x)}M^{3+}{}_{x}(OH)_2(NO_3)_x\cdot(m+n)H_2O \ (z=1+n-x/2)$$

The compound of the formula (4) has been known as a compound having ia larger anion exchange capacity when compared with the hydrotalcite-type compound of the formula (1).

Further, the elimination of OH, $A^{n-}$ and $H_2O$ is caused reversibly, so that the compound of the formula (4) has similar properties as the hydrotalcite-type compound of the formula (1).

In the above-mentioned formula (4), the molar fraction X of $M^{3+}$ ($0<X\leqq 0.5$) may preferably be in the range of $0.2\leqq X$ ($\leqq 0.5$), particularly $0.25\leqq X$ ($\leqq 0.5$) in view of the scattering prevention effect since there has been known that a nitrate ion adsorption capacity (anion exchange capacity) is enhanced with a larger molar fraction X. In view of a stability qf a crystal structure, the molar fraction X may preferably be in the range of $0<X\leqq 1/3$ (0.33) since mutual positive charge repulsion between lattice points where $M^{3+}$ is substituted by $M^{2+}$ may presumably become stronger.

The compound of the formula (4) is also considered to have an adsorptivity to NOx gas (nitrogen oxides) and thus is considered to be very effective in suppressing the toner particle scattering due to a synergistic effect such that formation of nitrate ion per se is suppressed by the NOx gas adsorptivity in addition to inactivation of nitrate ion by the anion exchange reaction.

In the above mentioned formula (4), specific examples of the divalent metal ion $M^{2+}$ may include: $Mg^{2+}$, $Ca^{2+}$, $Sr^{2+}$, $Ba^{2+}$, $Zn^{2+}$, $Ni^{2+}$, $Cd^{2+}$, $Sn^{2+}$, $Pb^{2+}$, $Fe^{2+}$ and $Cu^{2+}$, and those of the trivalent metal ion $M^{3+}$ may include $In^{3+}$, $Sb^{3+}$, $B^{3+}$ and $Ti^{3+}$. These cations ($M^{2+}$ and $M^{3+}$) may be used singly or in combination of two or more species and may also be used in combination with other cations having a valence of 1 or at least 4.

Of the above specific cations for $M^{2+}$ and $M^{3+}$, in view of industrial and inexpensive availability, $Mg^{2+}$ and $Al^{3+}$ may particularly preferably be used as $M^{2+}$ and $M^{3+}$, respectively.

As described above, a particularly preferred compound as the compound of the formula (4) is represented by the following formula (5):

$$Mg_{(1-x)}Al_{x}O_{(1+x/2)}\cdot mH_2O \quad (5),$$

wherein $0<X\leqq 0.5$ and $m\geqq 0$.

Specific examples of the compound of the formula (5) may include:

1. $Mg_{0.68}Al_{0.32}O_{1.16}$
2. $Mg_{0.8}Al_{0.2}O_{1.1}$
3. $Mg_{0.75}Al_{0.25}O_{1.125}$
4. $Mg_{0.83}Al_{0.17}O_{1.085}$

The compound of the formula (5) may further contain a small amount (e.g., at most 0.1 as a (total) molar fraction) of cations other than $Mg^{2+}$ and $Al^{3+}$, such as $Li^{+}$, $Na^{+}$, $K^{+}$, $Ag^{+}$, $Cu^{+}$, $Ca^{2+}$, $Sr^{2+}$, $Ba^{2+}$, $Zn^{2+}$, $Ni^{2+}$, $Cd^{2+}$, $Sn^{2+}$, $Pb^{2+}$, $Fe^{2+}$, $Cu^{2+}$, $Fe^{3+}$, $Co^{3+}$, $Bi^{3+}$, $In^{3+}$, $Sb^{3+}$, $B^{3+}$, and $Ti^{3+}$, and a small amount of anions other than $CO_3{}^{2-}$, without impairing the scattering prevention effect.

Even if such other cations and/or anions are used in a total molar fraction above 0.1, respectively, the resultant hydrotalcite-type compound does not substantially adversely affect the scattering prevention effect, thus being sufficient usable in the present invention as the compound falling under the definition of the formula (4).

Hereinbelow, the nitrate ion adsorbent and the layer-structure compounds represented by the above-mentioned formulas (1) to (5) is sometimes simply referred to as an "adsorbent".

The intermediate transfer member according to the present invention has a surface where an adsorbent as described above is present.

In the present invention, the adsorbent may be present at the intermediate transfer member surface in any form or state by any means for providing it onto the intermediate transfer member surface so long as the presence of the adsorbent at the surface of the intermediate transfer member is ensured.

Figure 4:
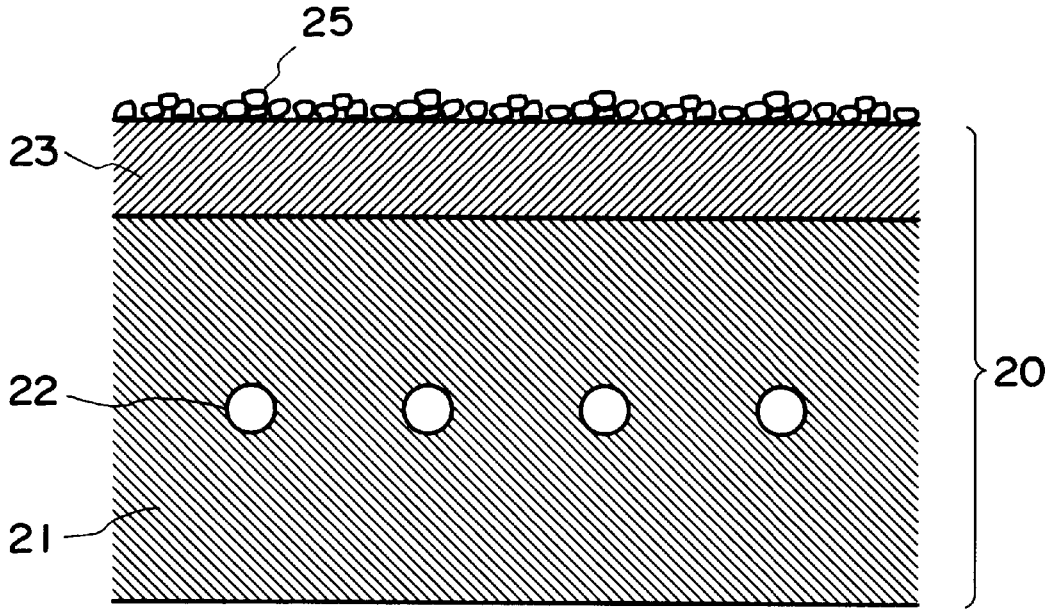
FIGS. 4 and 5 are schematic sectional views showing embodiments of an adsorbed state of an (nitrate ion) absorbent attached to the intermediate transfer member of the present invention, respectively.
Figure 5:
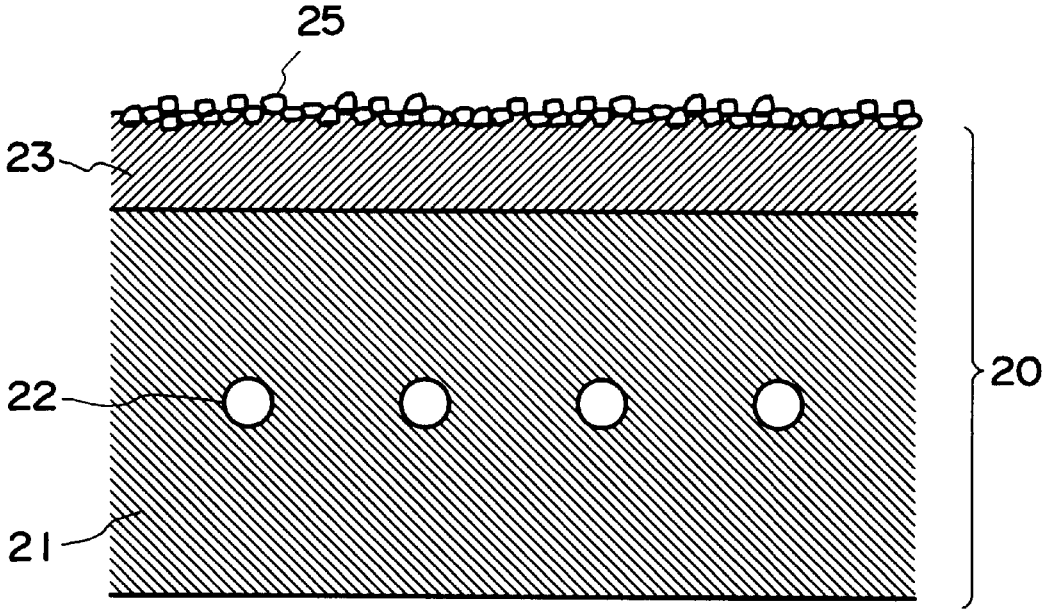

For example, the adsorbent may be attached to the surface of an intermediate transfer member (e.g., intermediate transfer belt) as shown in FIG. 4 or may be partially embedded into the intermediate transfer member (e.g., intermediate transfer belt) surface as shown in FIG. 5. Further, the adsorbent may be internally added in the intermediate transfer member (particularly a surface layer thereof).

In FIGS. 4 and 5, an intermediate transfer belt 20 includes a base layer 21 containing therein fibers 22 (at a center portion in its thickness direction), a coating (surface) layer 23 disposed on the base layer 21, and an adsorbent (adsorbent particles) 25 disposed on or partially embedded in the coating layer 23.

In order to enhance the scattering prevention effect and a secondary transfer efficiency (from the intermediate transfer member to a secondary image-bearing member), the adsorbent may preferably be considerably exposed to ambient air (e.g., at an exposed area of at least 50% of the entire surface area of the adsorbent).

The presence of the adsorbent may, e.g., be achieved by coating or application during a production process of the intermediate transfer member.

At the surface of the intermediate transfer member, the adsorbent may preferably be present in an amount (attached amount) of 0.1–2000 mg/1000 $cm^2$, more preferably 1–500 mg/1000 $cm^2$.

The adsorbent used in the present invention may preferably be used in the form of powder or solidified product thereof.

Figure 6:
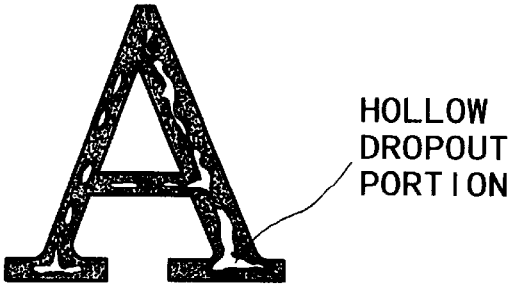
FIG. 6 illustrates a hollow dropout image.

When the adsorbent is powdery one, the adsorbent present at the intermediate transfer member surface lowers a contact area of the intermediate transfer member with toner particles, thus improving the secondary transfer efficiency. As a result, a hollow product image as shown in FIG. 6 and defective images resulting from cleaning failure are not readily caused to occur.

The powdery adsorbent may be formed in a porous shape to further decrease the contact area between the adsorbent and toner particles, thus further enhancing the resultant secondary transfer efficiency.

Further, when the adsorbent is porous powder, a contact area of the adsorbent with nitrate ions is increase thereby to increase a nitrate ion adsorption speed, thus improving the scattering prevention effect.

The adsorbent may preferably comprises particles having a weight-average particle size (Dw) of 0.005–100 $\mu$m, preferably 0.05–10 $\mu$m, more preferably 0.1–1 $\mu$m. Below 0.005 $\mu$m, the improvement effect of the secondary transfer efficiency becomes small. Above 100 $\mu$m, a larger surface unevenness is formed on the intermediate transfer member surface and leads to different secondary transfer efficiencies between projections and recesses, thus lowing a uniformity of an image density.

The adsorbent may preferably have a specific surface area $S_{BET}$ (as a BET surface area) of at least 1 ($m^2$/g). Below 1 ($m^2$/g), the scattering prevention effect is lowered and an improvement in the secondary transfer efficiency becomes slight. The lowered scattering prevention effect may be attributable to a slow nitrate ion adsorption speed due to a smaller $S_{BET}$, thus rendering the scattering prevention effect small. The slight improvement of the secondary. transfer efficiency may be attributable to less decrease in contact area of the adsorbent with toner particles due to a smaller polarity.

The $S_{BET}$ may more preferably be at least 2 ($m^2$/g), further preferably 8–500 ($m^2$/g).

The $S_{BET}$ value may be measured in the following manner.

200 mg of a sample (adsorbent powder) is heated and evacuated at 105° C. for 15 min., followed by subjected to measurement according to the BET method with nitrogen gas by using a full-automatic surface area measuring apparatus ("Multi-Sorb 12", mfd. by Yuasa Aionics Co.).

In recent years, a small-sized intermediate transfer member is required in accordance with downsizing of an image forming apparatus.

Figure 7:
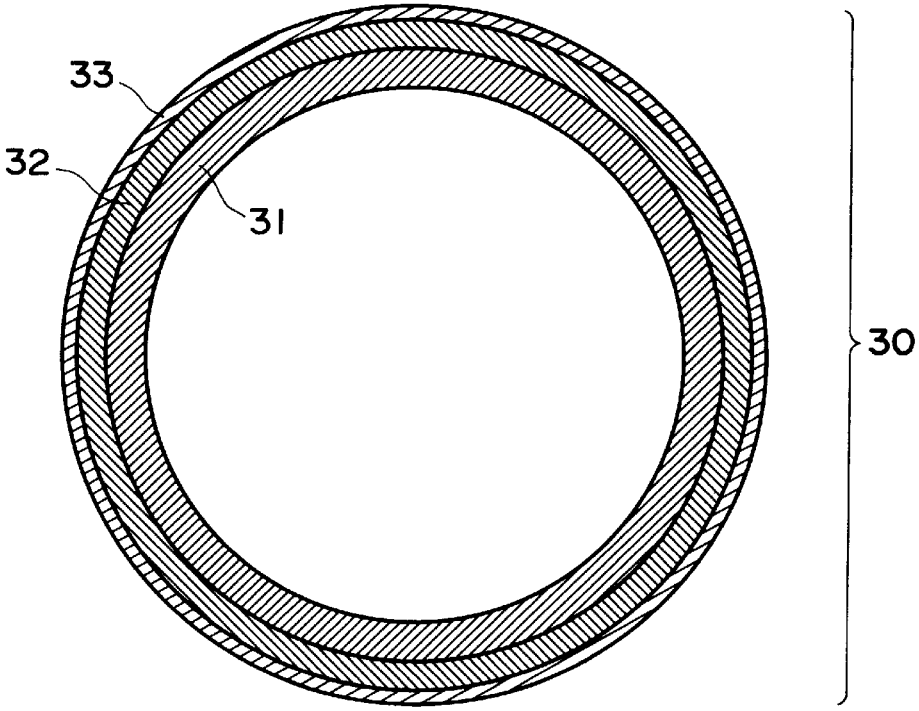
FIGS. 7 and 8 are schematic sectional views of the intermediate transfer members of the present invention in a drum-shape and a belt-shape, respectively.
Figure 8:
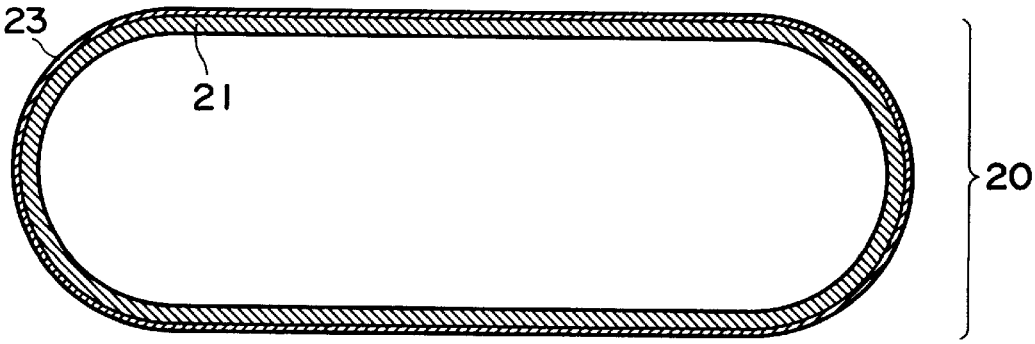

The intermediate transfer member of the present invention may generally have a drum-shape as shown in FIG. 7 and a belt-shape as shown in FIG. 8.

Referring to FIG. 7, an intermediate transfer drum 30 includes a support 31, an elastic layer 32 disposed on the support 31, and a coating layer 3 disposed on the elastic layer 32. Referring to FIG. 8, an intermediate transfer member 20 includes a base layer 21 and a coating (surface) layer 23 disposed on the base layer 21.

In view of the small-sized apparatus, there has been frequently used the intermediate transfer member as shown in FIG. 8.

The intermediate transfer belt is, however, used in a form such that the intermediate transfer belt is passed around pulleys (belt-supporting rollers) under tension, thus being essentially deformed during an image formation operation. As mentioned above, it is effective to keep a small potential difference $\Delta V$ between the image and non-image portions in order to prevent the scattering of toner particles primary-transferred onto the intermediate transfer belt. However, if the intermediate transfer belt is deformed during the image formation operation, the deformed intermediate transfer belt causes a mechanical scattering action to toner particles carried thereon. As a result, in a conventional intermediate transfer belt (with no adsorbent), as a successive image formation proceeds, i.e., as nitrate ions attach to the intermediate transfer belt surface to lower an electrical resistance of the intermediate transfer belt, the toner scattering is liable to be caused to occur.

Figure 9:
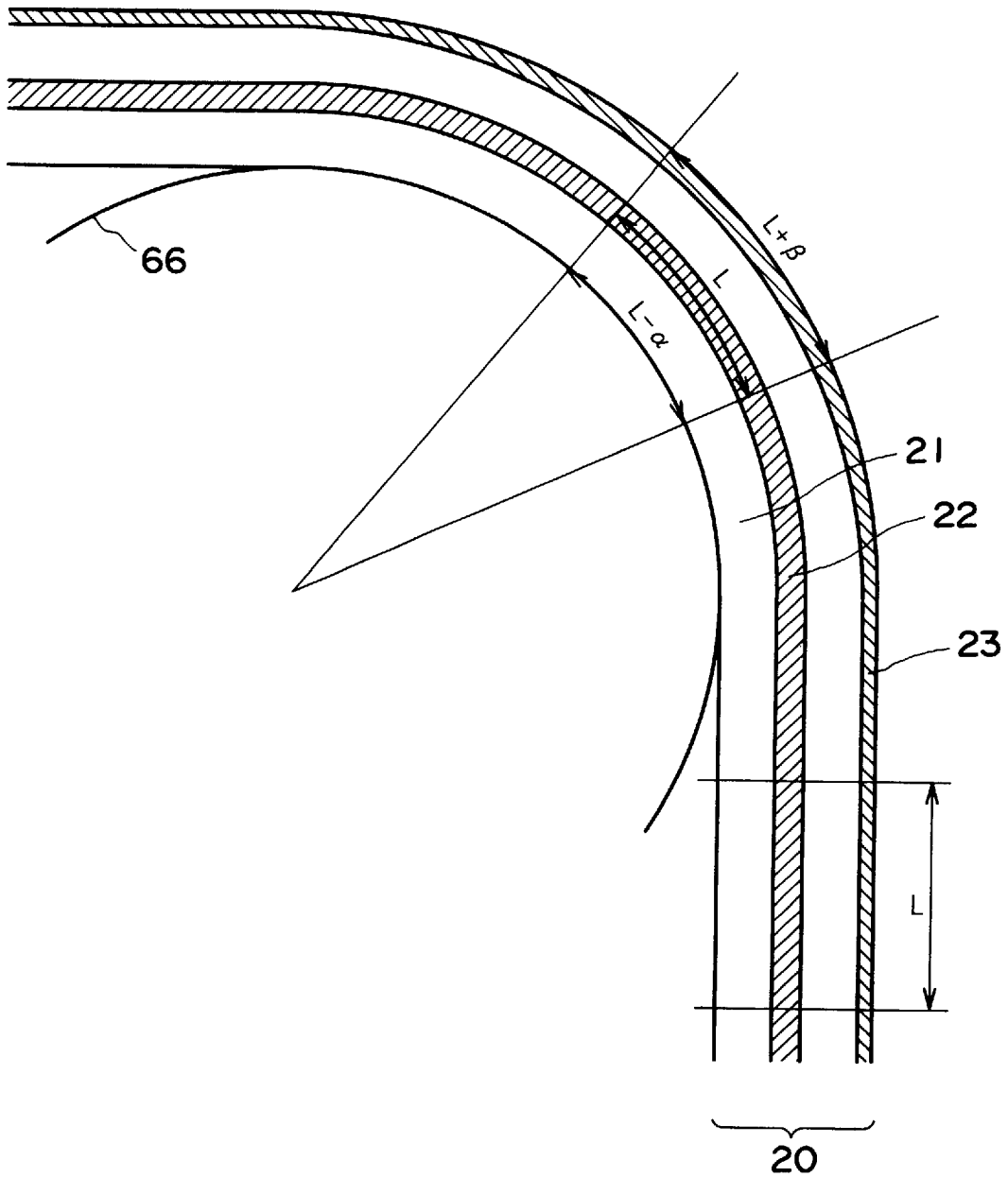
FIG. 9 is a partial side view for illustrating a state of expansion and contraction of a belt-shape intermediate transfer member at a pulley portion.

Particularly, in the case of a fiber-reinforced rubber is used as an intermediate transfer belt, the resultant intermediate transfer belt generally has a thickness of 0.5–2 mm. In this instance, as shown in FIG. 9, an appropriate straight portion of a length L is taken along the intermediate transfer belt 20. When the portion arrives at the position of a pulley 66, an outer surface (coating) layer 23 is elongated to a length L+B and an inner surface (base) layer 21 is shrunk to L-$\alpha$ ($\alpha$, $\beta$: positive values) while keeping the length L for an intermediate layer (fibers) 22. After the portion passes the pulley 66, the portion is restored to a length L. Accordingly, in the vicinity of the position of the pulleys 66, the intermediate transfer belt surface portion is largely elongated and shrunk to readily cause the toner particle scattering.

In the present invention, however, the surface of the intermediate transfer belt is provided with the adsorbent, whereby it becomes possible to maintain a small surface potential difference $\Delta V$ between the image and non-image portions even after the successive image formation. Accordingly, the belt-shaped intermediate transfer member (intermediate transfer belt) is a particularly preferred embodiment of the intermediate transfer member of the present invention since it is possible to provide a small-sized image-forming apparatus without impairing the scattering prevention effect (improved image qualities).

As one of cleaning methods for removing a transfer residual toner on the intermediate transfer member, it is possible to adopt a so-called electrostatic cleaning scheme wherein the transfer residual toner is charged to have a polarity opposite to that of a photosensitive member by using a charging member for a transfer residual toner, thereby to transfer the transfer residual toner onto the photosensitive member to effect cleaning thereof.

Another cleaning method may include a so-called blade cleaning scheme wherein the transfer residual toner is removed by contacting a blade with the intermediate transfer member surface. However, the blade cleaning scheme is liable to cause a deterioration of the blade, thus leading to an occurrence of cleaning failure.

On the other hand, the electrostatic cleaning scheme has the advantage of freedom of the cleaning failure occurrence due to the blade deterioration. Further, when a step of transferring the transfer residual toner (on the intermediate transfer member) onto the photosensitive member is performed simultaneously with a primary transfer step for a subsequent image (which may be called a "concurrent primary transfer-cleaning scheme"), it is possible to effect the cleaning of the intermediate transfer member without lowering throughput of the image forming apparatus. Accordingly, in the present invention, the concurrent primary transfer-cleaning scheme may preferably be employed for compatibly achieving the throughput and cleaning performances.

As described above, the electrostatic cleaning scheme such as the concurrent primary transfer-cleaning scheme has the advantage of allowing good cleaning performances for a long period but causes a discharge between the transfer residual toner charging member and the intermediate transfer member due to application of a DC voltage or a DC voltage superposed with an AC voltage to the transfer residual toner charging member. The occurrence of the discharge leads to ozone formation, thus resulting in formation of a charging product such as nitric acid.

Particularly, in the case of applying the DC voltage superposed with the AC voltage to the transfer residual toner charging member in order to improve the cleaning performances, a larger discharge is liable to occur, thus generating a larger amount of nitric acid. For this reason, the electrostatic cleaning scheme as the cleaning method for the intermediate transfer member has been accompanied with a difficulty such that the toner particle scattering is accelerated during the successive image formation when compared with other cleaning schemes such as the blade cleaning scheme.

However, the intermediate transfer member according to the present invention has a surface to which the adsorbent is attached, so that it is possible to prevent a lowering in electrical resistance of the intermediate transfer member during the successive image formation even when incorporated in an image forming apparatus employing the electrostatic cleaning scheme, thus suppressing the toner particle scattering during the successive image formation. Accordingly, the intermediate transfer member of the present invention is most effectively used in the image forming apparatus in combination with the electrostatic cleaning scheme.

The belt-shaped intermediate transfer member of the present invention may be prepared by forming one or two or more resin layers in a belt-shape. For example, the belt-shaped intermediate transfer member may have a structure such that a resin layer is disposed on a fiber-reinforced rubber layer as shown in FIGS. 10 and 11.

Figure 10:
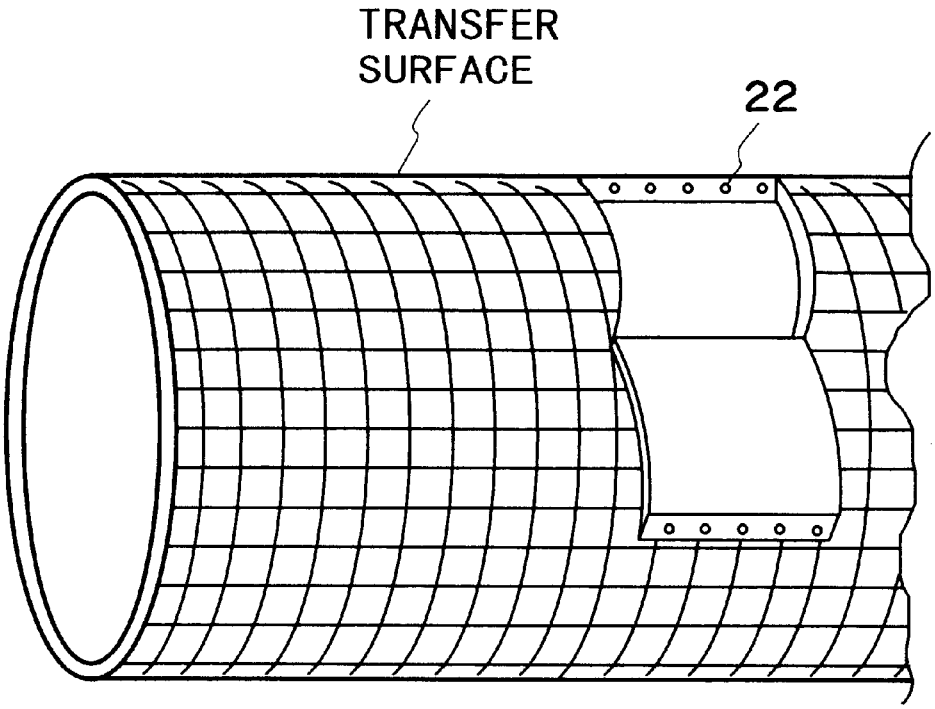
FIGS. 10 and 11 are partially exploded perspective views of belt-shaped intermediate transfer members of the present invention reinforced with woven fibers (filaments) and yarn (thread) fibers, respectively.

In FIG. 10, a rubber layer is reinforced with a woven fabric or cloth comprising filaments or threads crossing each other. In FIG. 11, a rubber layer is reinforced with a spiral filament embedded therein.

Figure 11:
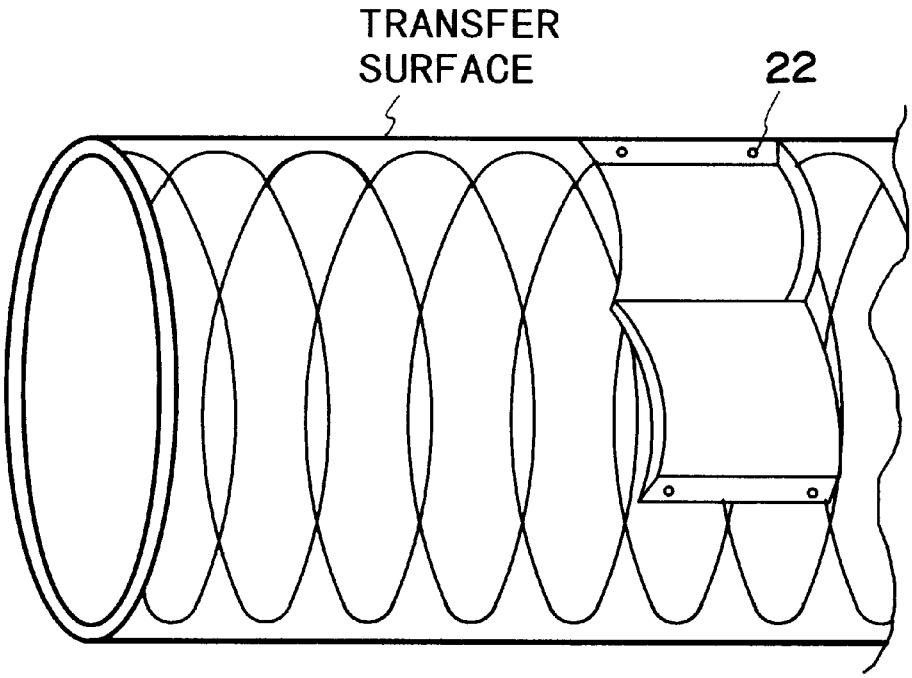

The belt-shaped intermediate transfer member having the structure as shown in FIG. 11 may be prepared more easily.

Examples of a preferred material for the fibers or filaments (threads) may include cotton and polyester fiber in terms of strength and cost.

The fibers used may be comprised of a mono-filament or a thread or yarn comprising a twist or twined plurality of fibers, or a thread or yarn of plural fiber species in mixture.

The woven fabric for reinforcing the rubber layer constituting the intermediate transfer belt may be knitted fabric, union fabric or other fabrics.

In the intermediate transfer belt, the rubber layer may preferably have a thickness of 0.5–2 mm, more preferably 0.5–1 mm. This is because it is generally difficult to form a rubber belt having a thickness below 0.5 mm and above 2 mm, it is generally difficult to perform a smooth drive operation of the intermediate transfer belt. Further, a thicker rubber layer provides a larger elongation of the intermediate transfer belt surface at a pulley portion, thus resulting in a larger mechanical force for the toner particle scattering. Accordingly, the rubber (base) layer having a thickness of at most 1 mm may preferably be used in view of less scattering of toner particles.

The rubber layer may preferably have a hardness (JIS-A hardness) of at most 85 degrees as measured according to JIS-K6301 because of less occurrence of a hollow dropout image.

The intermediate transfer belt (belt-shaped intermediate transfer member) of the present invention may preferably have a tensile (Young's) modulus in a peripheral direction (thereof) of at least $1\times10^7$ Pa, more preferably at least $3\times10^7$ Pa, further preferably at least $1\times10^8$ Pa, irrespective of the intermediate transfer belt material, since the elongation and shrinkage caused during the rotation of the intermediate transfer belt is alleviated to lower the mechanical toner scattering action on the intermediate transfer belt, thus decreasing the scattered toner particles.

In production of the intermediate transfer member of the present invention, it is possible to employ various rubbers, elastomers and resins.

Examples of the rubbers and elastomers may include: isoprene rubber, styrene-butadiene rubber, butadiene rubber, butyl rubber, ethylene-propylene rubber, ethylene-propylene-diene terpolymer (EPDM), chloroprene rubber, chlorosulfonated polyethylene, chlorinated polyethylene, acrylonitrile-butadiene rubber, urethane rubber, syndiotactic 1,2-polybutadiene, epichlorohydrin rubber, acrylic rubber, silicone rubber, fluorine rubber, hydrogenated nitrile rubber, thermoplastic elastomers (such as those of the polystyrene type, polyolefin type, polyvinyl chloride type, polyurethane type, polyamide type, polyester type, and fluorine-containing resin type).

Examples of the resins may include: polyvinyl acetate, polyester, polyarylate, polysulfone, polyethersulfone, polyethylene terephthalate, polybutylene terephthalate, polycarbonate, polyethylene, polypropylene, polybutadiene, polyvinylidene chloride, ionomer resin, polyurethane resin, silicone resin, fluorine-containing resin, polyamide, aromatic polyamide, modified polyphenylene oxide resin, and polystyrene.

These materials for the intermediate transfer member may be used singly or in mixture of two or more species. The above are, however, not exhaustive.

It is possible to add an electroconductivity-imparting additive to the intermediate transfer member of the present invention. Examples of the conductivity-imparting agent may include: carbon black, powder of metal such as aluminum or nickel, metal oxide such as titanium oxide, and electroconductive polymers, such as quaternary ammonium salt-containing polymethyl methacrylate, polyvinylaniline, polyvinylpyrrole, polydiacetylene, polyethyleneimine, boron-containing polymers, and polypyrrole. These may be used singly or in combination of two or more species. These conductivity-imparting additives are not exhaustive.

In order to prevent the toner scattering on the intermediate transfer member surface from an initial stage of a successive image formation, the intermediate transfer member may preferably be constituted by a plurality of layers including a surface (outermost) layer having a high electrical resistance (or volume resistivity).

The surface layer may preferably have a volume resistivity of at least $1\times10^{11}$ ohm.cm in the case of the drum-shaped intermediate transfer member and a volume resistivity of at least $1\times10^{14}$ ohm.cm.

This is because the drum-shaped intermediate transfer member is little deformed during the rotation thereof but the belt-shaped intermediate transfer member is deformed as described above, thus requiring a higher volume resistivity of its surface layer for keeping the potential difference between the image and non-image portions smaller.

There is no upper limit of the volume resistivity of the surface layer of the intermediate transfer member in view of the scattering prevention effect but a substantial upper limit thereof may be $1\times10^{18}$ ohm.cm in view of current materials for the surface layer.

The surface layer of the intermediate transfer member may preferably have a thickness of 5–100 $\mu$m.

Above 100 $\mu$m, the resultant electrical resistance of the intermediate transfer member becomes too high, whereby a primary transfer current does not readily flow, thus failing to perform the primary transfer well. Below 5 $\mu$m, the effect of allowing a slow attention of the non-image portion potential by the surface layer becomes small, thus being liable to cause the toner particle scattering.

In the present invention, the intermediate transfer member may be composed of a single layer and a plurality of layers and may have a volume resistivity of,e .g., $10^5$–$10^{11}$ ohm.cm so long as the desired scattering prevention effect is attained.

Herein, the volume resistivity (e.g., in Examples and Comparative Examples appearing hereinafter) may be measured in the following manner.

<Apparatus>

Resistance meter: High resistance meter ("R8340A", mfd. by Advantest Co.)

Resistance (sample) box: principal electrode diameter=50 mm, guard ring inner diameter=70 mm, guard ring outer diameter=80 mm ("TR42", mfd. by Advantest Co.)

<Sample>

A sample is prepared by cutting a measuring layer into two square sheets each of 10×10 cm (for measurement at an initial stage and after a successive image formation, respectively).

If the measuring layer is too thin or composed of a specific layer of a plurality of layers (e.g., in the case of the drum-shaped intermediate transfer member as in Examples 5 and 22 and Comparative Example 2), the measuring layer is formed on an aluminum sheet (instead of, e.g., a metal cylinder as a support) and cut into a square sheet (10×10 cm).

<Conditions>

Environment: 22–23° C. and 5–60% (RH). The sample is subjected to measurement after left standing for at least 24 hours in this environment.

Applied voltage: 100 (V) (or 1 (V) in the case where the volume resistivity is not measurable by the action of a limiter (300 mA) (e.g., in Comparative Examples 3 and 5).

Measuring mode: program mode 5 (discharge=10 sec., charging and measurement=30 sec.).

An image forming apparatus including the intermediate transfer member (intermediate transfer belt) of the present invention (used as c color copying machine or laser beam printer) will now be described with reference to FIG. 1.

The apparatus includes a rotating drum-type electrophotographic photosensitive member (hereinafter called "photosensitive drum") 1 repetitively used as a first image-bearing member, which is driven in rotation in a counterclockwise direction indicated by an arrow at a prescribed peripheral speed (process speed).

During the rotation, the photosensitive drum 1 is uniformly charged to a prescribed polarity and potential by a primary charger 2 and then exposed to imagewise light 3 supplied from an imagewise exposure means (not shown) to form an electrostatic latent image corresponding to a first color component image (e.g., a yellow color component image) of an objective color image.

Then, the electrostatic latent image is developed with a yellow toner Y (first color toner) by a first developing device (yellow developing device 41). At this time, second to fourth developing devices (magenta developing device 42, cyan developing device 43 and black developing device 44) are placed in an operation-off state and do not act on the photosensitive drum 1, so that the yellow (first color) toner image thus formed on the photosensitive drum 1 is not affected by the second to fourth developing devices.

An intermediate transfer member (belt) 20 is supported about rollers 64, 65 and 66 and rotated in a clockwise direction at a peripheral speed equal to that of the photosensitive drum 1.

As the yellow toner image formed and carried on the photosensitive drum 1 passes through a nip position between the photosensitive drum 1 and the intermediate transfer member 20, the yellow toner image is transferred onto an outer surface of the intermediate transfer member 20 under the action of an electric field caused by a primary transfer bias voltage applied from a primary transfer roller 62 to the intermediate transfer member 20 (primary transfer).

The surface of the photosensitive drum 1 after the transfer of the yellow (first color) toner image onto the intermediate transfer member 20 is cleaned by a cleaning device 13.

Thereafter, a magenta (second color) toner image, a cyan (third color) toner image and a black (fourth color) toner image are similarly formed on the photosensitive drum 1 and successively transferred in superposition onto the intermediate transfer member 20 to form a synthetic color toner image corresponding to an objective color image.

The transfer bias voltage for sequential transfer in superposition of the first to fourth color toner images from the photosensitive drum 1 onto the intermediate transfer member 20 is supplied in a polarity (+) opposite to that of the toner from a bias voltage supply 29. The voltage may preferably be in the range of, e.g., +100 volts to +2 kvolts.

For secondary transfer of the synthetic color toner image formed on the intermediate transfer member 20 onto a transfer-receiving material P (second image-bearing member), such as (recording) paper, a secondary transfer roller 63 is supported on a shaft in parallel to the roller (secondary transfer opposing roller) 64 and so as to be contactable onto a lower (but outer) surface of the intermediate transfer member 20. During the primary transfer steps for transferring the first to third color images from the photosensitive drum 1 onto the intermediate transfer member 20, the secondary transfer roller 63 and a transfer residual toner charging member (roller) 52 can be separated from the intermediate transfer member 20.

For the secondary transfer, the secondary transfer roller 63 is abutted against the intermediate transfer member 20, a transfer-receiving material P is supplied via paper supply rollers 11 and a guide 10 to a nip position between the intermediate transfer member 20 and the secondary transfer roller 63 at a prescribed time and, in synchronism therewith, a secondary transfer bias voltage is applied to the secondary transfer roller 63 from a power supply 28. Under the action of the secondary transfer bias voltage, the synthetic color toner image on the intermediate transfer member 20 is transferred onto the transfer-receiving material (second image-bearing member) P (secondary transfer). The transfer-receiving material P carrying the toner image is introduced into a fixing device to effect heat fixation of the toner image.

After completion of image transfer onto the transfer-receiving material P, the (transfer residual toner) charging member 52 connected to a bias voltage supply 26 is abutted to the intermediate transfer member 20 to apply a bias voltage of a polarity opposite to that of the photosensitive drum 1, whereby a transfer residual toner (a portion of toner remaining on the intermediate transfer member 20 without being transferred onto the transfer-receiving material P) is imparted with a charge of the opposite polarity. Then, the charged transfer residual toner is electrostatically transferred back to the photosensitive drum 1 at a nip position or a proximity thereto, whereby the intermediate transfer member 20 is cleaned.

In the present invention, an adsorbent application means may preferably be disposed in the vicinity of the intermediate transfer member, whereby the adsorbent is successively or continually supplied (applied) to the intermediate transfer member surface at an appropriate timing during the image formation operation to achieve the scattering prevention effect for a long period.

In this instance, the adsorbent may preferably be uniformly applied to at least the entire image forming region (a region capable of being subjected to the primary transfer) on the intermediate transfer member surface. When the adsorbent application is not performed uniformly, the scattering prevention effect becomes irregular or uneven over the application region, thus partially failing to attain the scattering prevention effect in some cases. Further, it also causes an irregular secondary transfer efficiency to result in an uneven image density. When an agglomerated adsorbent portion is prevent at the intermediate transfer member surface, such an adsorbent portion is transferred onto the transfer-receiving material (e.g., paper), thus leading to defective images.

In order to effect the adsorbent application to the intermediate transfer member surface uniformly, the adsorbent application means may preferably comprise an application member in the form of a brush, a roller or a blade.

Examples of the adsorbent application means used in the present invention are shown in FIGS. 12–15.

Figure 12:
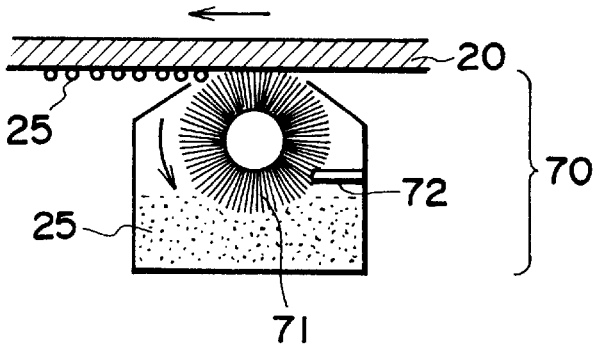
FIGS. 12, 13 and 15 are schematic illustrations of embodiments of adsorbent application means having a brush, a roller and a blade, respectively.

FIG. 12 shows an adsorbent application means 70 having an application brush 71.

Referring to FIG. 12, the application means 70 includes the brush 71 in a roller form, a blade 72 for regulating an amount of an adsorbent 25, and an adsorbent 25 contained in a vessel, and is disposed so that the rotating brush 71 contacts an image-bearing surface of the intermediate transfer member 20 to leave thereon a prescribed amount of adsorbent 25. The application brush 71 may be formed in a bar-shape or a belt-shape instead of the roller-shape shown in FIG. 12.

The application brush may preferably comprise bristles or fibers having a length of 0.5–20 mm, more preferably 2–5 mm, and having a size of 1–200 D (denier), more preferably 3–50 D.

If the fibers have a length below 0.5 mm, it becomes difficult to produce a brush. Above 20 mm, the resultant application means 70 becomes large in size.

If the size of the fibers is below 1 D, the resultant brush has a small stiffness and uniform application becomes difficult. Above 200 D, the fibers of the brush becomes too stiff and are liable to mar the intermediate transfer member surface during the application operation of the adsorbent 25.

The fibers of the brush may preferably have a density of 500–$10^5$ (fibers)/$cm^2$, more preferably 1000–50000 (fibers)/$cm^2$. Below 500 (fibers)/$cm^2$, a spacing between adjacent fibers becomes large. As a result, the adsorbent 25 is liable to be passed through the spacing of the fibers, thus resulting in a difficult uniform application. Above $10^5$ (fibers)/$cm^2$, it is difficult to produce such a high-density brush inexpensively.

Examples of a material for the fibers of the application brush may preferably include: rayon, acrylic fiber, nylon fiber, polyester fiber, polyethylene fiber, polypropylene fiber, and other natural and synthetic fibers.

The application brush may further contain an electroconductivity-imparting agent (such as carbon black, graphic or metal powder) so as to appropriately control the resultant electrical resistance of the fibers.

Figure 13:
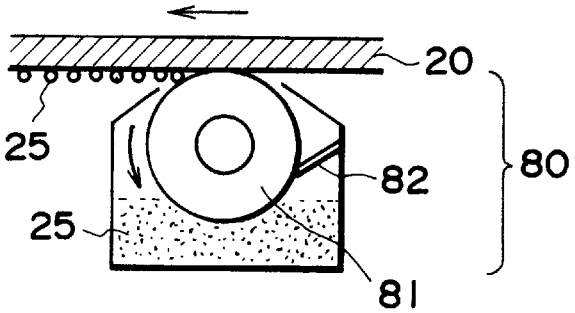

FIG. 13 shows an application means 80 having an application roller 81.

Referring to FIG. 13, the application means 80 includes the application roller 81, a blade 82 for regulating an amount of an adsorbent 25, and an adsorbent 25 contained in a vessel.

The application roller 81 may have a smooth surface and may preferably have a surface unevenness to a certain degree in order to improve a conveyance (application) ability for the adsorbent 25. In order to easily provide the application roller 81 with the surface unevenness, the application roller may preferably be composed of felt or a sponge, e.g., made of urethane foam. The urethane foam-made sponge may preferably be used in view of ease of its production and a small compression permanent set or strain. It is also possible to provide the application roller 81 surface with a crown (camber)-shape or a reverse crown-shape where the thickness of the application roller 80 is changed in its longitudinal (shaft extension) direction in order to enhance a uniformity of application in a longitudinal (width) direction of the intermediate transfer member 20.

Figure 14:
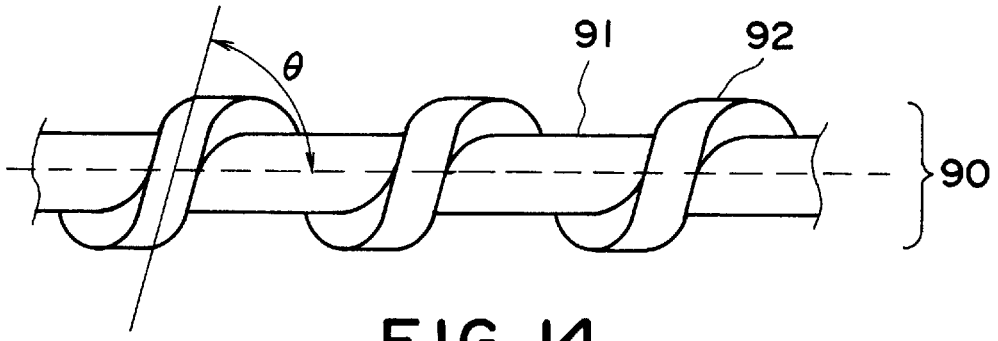
FIG. 14 is a partial schematic illustration of another embodiment of adsorbent application means having a spiral member.

Further, in the present invention, it is possible to employ a spiral application roller 90 as shown in FIG. 14 wherein a sponge member 91 (width=1–20 mm, thickness=1–10 mm) is spirally wound about a core metal 91 (10 deg., $\leqq\theta\leqq$80 deg). In this instance, by rotating the core metal 91 at an appropriate speed, it is possible to provide a rubbing force component in a direction perpendicular to the surface-moving direction of the intermediate transfer member between the sponge member 92 and the intermediate transfer member surface. As a result, it is possible to apply the adsorbent further uniformly while ensuring the attachment of the adsorbent onto the intermediate transfer member surface. It is also possible to use a felt member or a brush instead of the sponge member 92.

Figure 15:
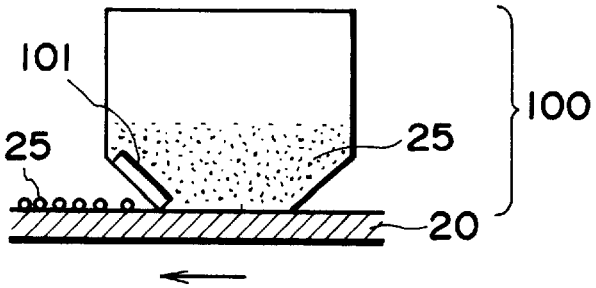

FIG. 15 shows an application means 100 having an application blade 101.

Referring to FIG. 15, the application means 100 includes the application blade 101 and an adsorbent 25 contained in a vessel and may optionally include an adsorbent-stirring device or mechanism (not shown) in order to allow uniform application. The application blade 101 may preferably comprise a polyurethane blade in view of an abrasive resistance.

The above-mentioned application means (70, 80, 90 and 100) as shown in FIGS. 12–15 may appropriately be modified and used as a part of the image forming apparatus of the present invention.

Examples of such modifications are shown in FIGS. 17, 18, 19 and 21.

Figure 17:
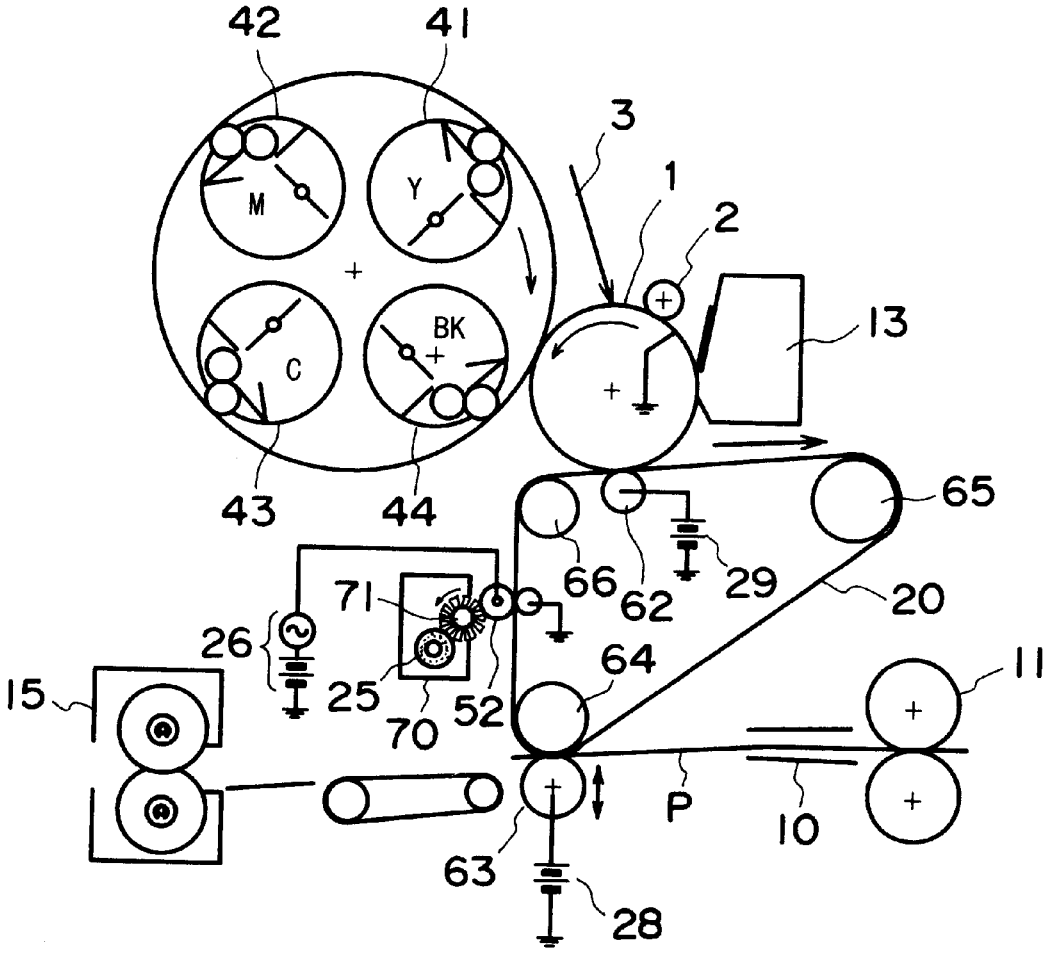
FIGS. 17–19 and 21 are schematic illustrations of image forming apparatus using intermediate transfer members of a belt-type provided with adsorbent application means different from each other, respectively, according to the present invention.
Figure 18:
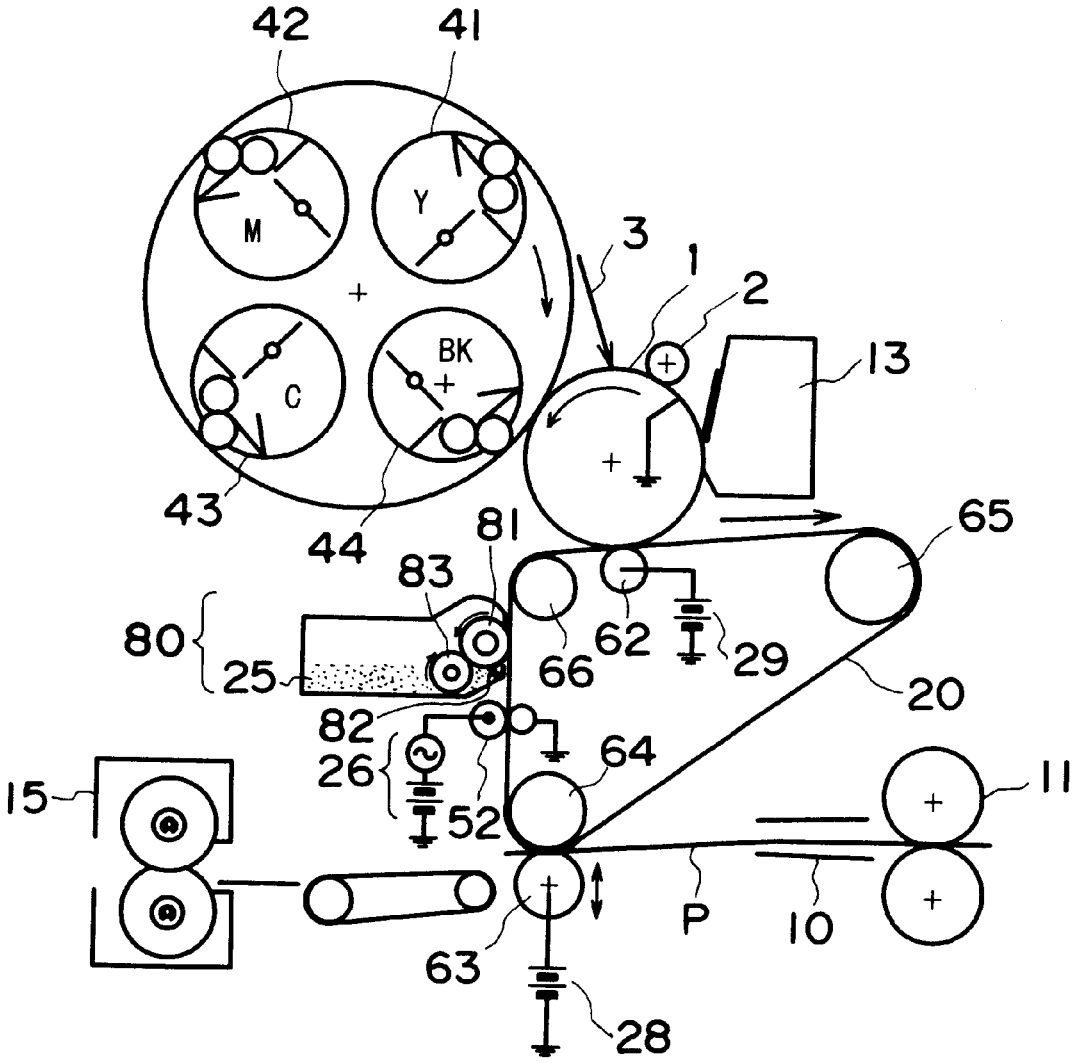
Figure 19:
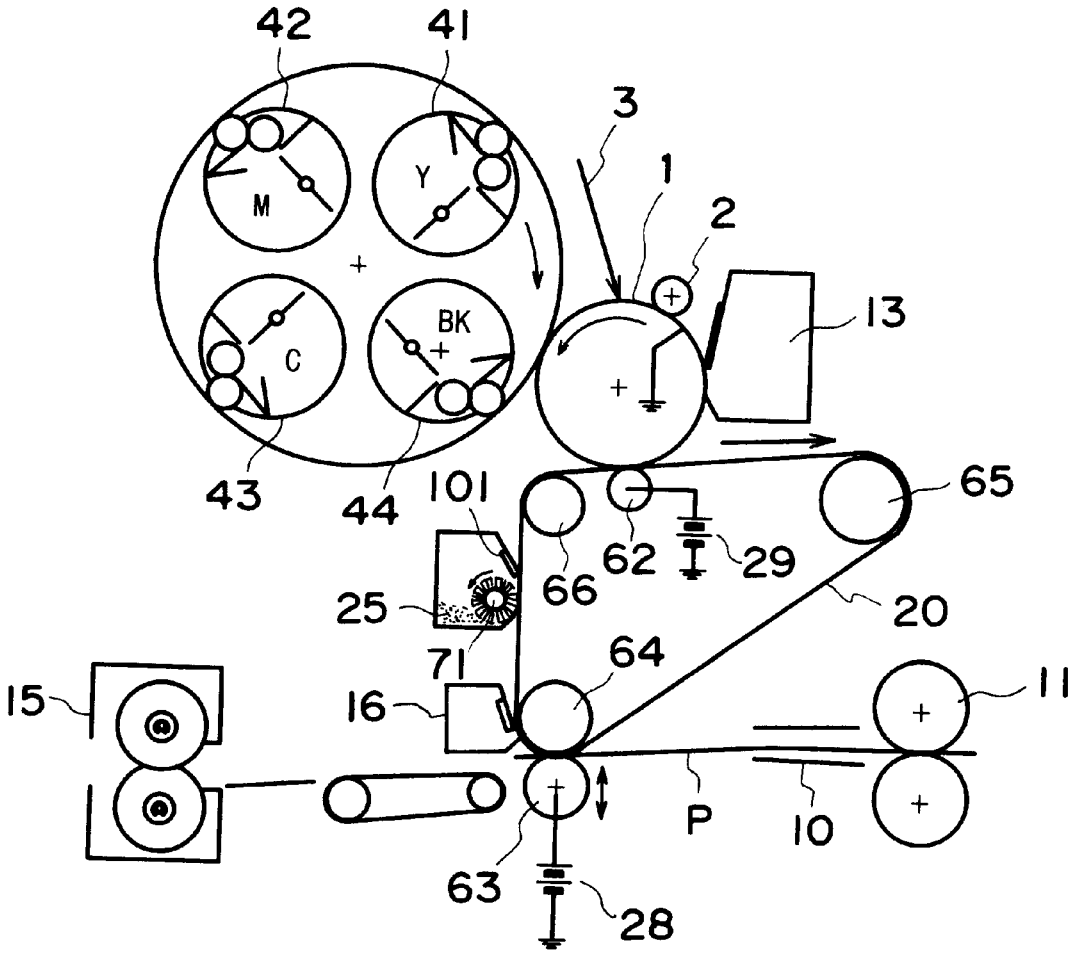
Figure 21:
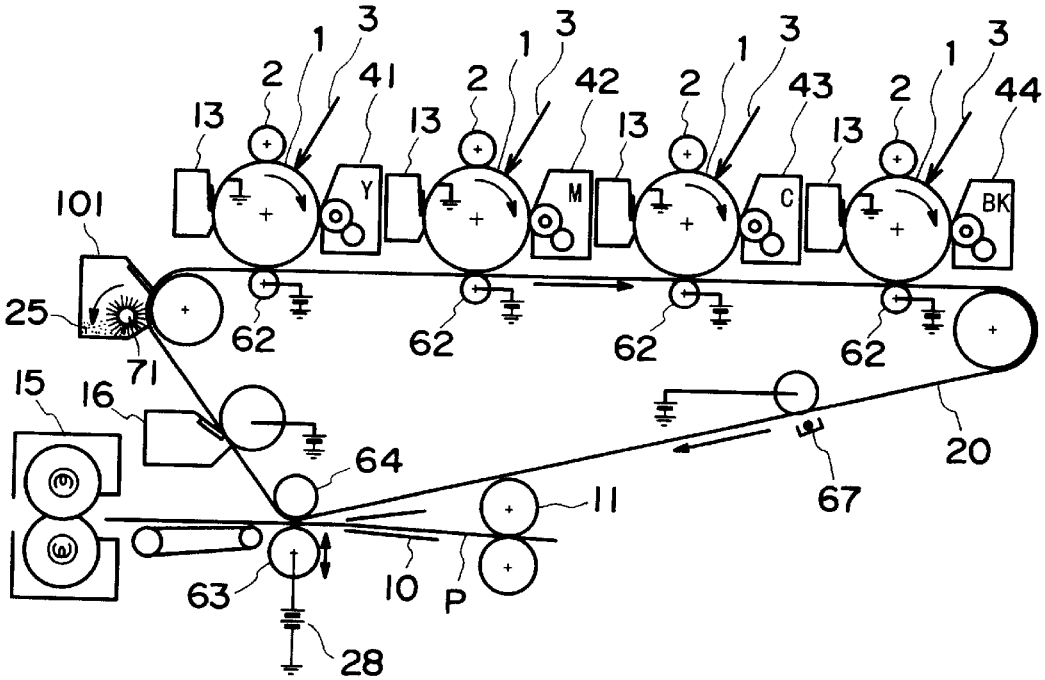

Specifically, in FIG. 17, the application means 70 includes a roller-shaped adsorbent 25 and the adsorbent 25 is indirectly applied to the intermediate transfer belt 20 surface via a charging roller 52 (for a transfer residual toner). In FIG. 18, the application means 80 further includes a mating roller 83 for supplying the adsorbent 25 to the application roller 81. In FIGS. 19 and 21, the application means includes the application brush 71 and the application blade 101 in combination.

In the case where the adsorbent is in a powdery form, such as adsorbent may be used as it is and may preferably be used in a state such that the powdery adsorbent is compressed under pressure to provide a solid like form and is then scraped off little by little to obviate a difficulty of powder handling (such as an easy escaping of the adsorbent from the application means during conveyance or image forming operation). It is also possible to melt-blend the adsorbent with another additive (e.g., zinc stearate or zinc oleate), followed by cooling to obtain a solidified adsorbent.

In the present invention, the application means may preferably be formed in a unit or cartridge detachably disposed in the vicinity of the intermediate transfer member in view of easy replacement with a new application means (unit) in the cases of a deterioration of the application member and complete consumption of the adsorbent.

Further, the adsorbent may be moved (transferred) to the intermediate transfer member surface based on an electrostatic force by applying an appropriate voltage to the application member and/or the intermediate transfer member.

The application member used in the present invention may preferably be disposed in a state being contactable to the intermediate transfer member and is required to be separated from the intermediate transfer member so as not to directly contact the toner particles primary-transferred onto the intermediate transfer member surface. The timing of the adsorbent application may appropriately be set so long as the primary-transferred toner particles and the application member do not directly contact each other. For instance, in an "OFF" state, the application member and the intermediate transfer member are separated from each other. After the (main) power of a main body of an image forming apparatus is turned "ON", the application member is abutted against the intermediate transfer member at a prescribed time before, during or after an initial (warm-up) operation to apply the adsorbent onto the intermediate transfer member surface and then is again separated from the intermediate transfer member. Thereafter, at a prescribed time (e.g., every 10–1000 sheets of image formation (output)), the application member is abutted against the intermediate transfer member and then is separated therefrom, thus continually replenishing the intermediate transfer member surface with a fresh adsorbent to further enhance the toner particle scattering prevention effect for a long period of time.

In the present invention, the above adsorbent application or supply onto the intermediate transfer member surface may be performed directly from the application member of the application means or indirectly therefrom via another member (e.g., a transfer residual toner charging roller).

In the case of using the adsorbent application means, an amount (supply amount) of adsorbent application (supply) may preferably be set in a range of 0.1 mg to 100 g per 1000 sheets (A4-sized) (of image formation), more preferably 1 mg to 10 g per 1000 sheets. Below 0.1 mg/1000 sheets, the scattering prevention effect is weakened. Above 100 g/1000 sheets, it is generally difficult to uniformly apply such a large amount of the adsorbent.

Herein, the amount of adsorbent application is determined by a decrease in weight (an amount of consumption) of the adsorbent (e.g., contained in a vessel of the application means) per 1000 sheets of image formation (output). Accordingly, in the case of the indirect adsorbent application, the adsorbent carried on another member between the application member and the intermediate transfer member is inclusively referred to as the amount of adsorbent application onto the intermediate transfer member.

In the intermediate transfer member and the image forming apparatus according to the present invention, it is possible to the adsorbent in combination with other additives such as an anti-oxidant (of a phenol-type, a phosphorus-type, an amine-type or a sulfur-type).

When the adsorbent and the anti-oxidant are used in combination, the scattering prevention effect is further heightened. This may be attributable to the reaction of the anti-oxidant with ozone, thus decreasing an amount of generation of NOx and nitric acid to provide a synergistic effect in combination with the adsorbent.

Hereinbelow, the present invention will be described more specifically based on Examples and Comparative Examples.

EXAMPLE 1

An electroconductive compound comprising NBR/EPDM (7/3) and carbon black was extruded into a 0.4 mm-thick tube.

A cylindrical metal mold was coated with the tube and about which a polyester yarn (diameter=120 $\mu$m) was spirally wound at a pitch of 0.7 mm, and then was further coated with a 0.4 mm-thick tube (having the same composition as the above-prepared one).

Thereafter, the resultant structure was taped up to cause the electroconductive compound to closely contact the metal mold, followed by vulcanization and grinding (polishing) to form a 0.8 mm-thick rubber belt (base layer) of 247 mm in width and 440 mm in outer peripheral length reinforced with the spiral yarn at a central portion in a thickness direction thereof.

The thus formed base layer had a JIS-A hardness of 70 deg., a volume resistivity (Rv) of $1\times10^7$ ohm.cm and a Young's modulus (E) of $1.3\times10^8$ Pa.

On the base layer, a polyether-polyurethane paint was sprayed and dried to be in a tacky dry state, followed by hot-drying at 100° C. for 30 min. to form a 10 $\mu$m-thick first coating layer (intermediate) layer.

On the intermediate layer, the polyester-polyurethane paint was sprayed and dried in the same manner as in the above polyether-polyurethane paint except for changing the hot-drying conditions to 120° C. and 1 hour to form a 10 $\mu$m-thick second coating layer (surface layer), thus preparing an intermediate transfer belt.

Then, an adsorbent was prepared by surface-treating a hydrotalcite-type compound ("Ad-1") ($Mg_{0.68}Al_{0.32}(OH)_2(CO_3)_{0.16}\cdot0.5H_2O$) with stearic acid to obtain a powdery absorbent ("ST-Ad-1") (specific surface area ($S_{BET}$)=10 $m^2/g$, weight-average particle size (Dw)=0.55 $\mu$m).

The thus-prepared adsorbent was attached onto the above intermediate transfer belt surface by electrostatic (powder)

painting to prepare an intermediate transfer belt (member) according to the present invention as shown in FIG. 4.

The attached adsorbent was present at an amount (attached amount) of 30 mg/1000 $cm^2$ obtained from a charge (decrease) in weight of the intermediate transfer belt before and after the electrostatic painting.

When the adsorbent (the hydrotalcite-type compound surface-treated (hydrophobicity imparting-treated) with stearic acid) was subjected to measurement of nitrogen concentration ($C_N$) (as a nitrate ion adsorption factor) in the above-mentioned manner, a resultant $C_N$ was 13.1 mg/l. The thus-measured $C_N$ value was above 13 mg/l. This is presumably because the mettability by nitric acid (to the adsorbent) is lowered by the stearic acid treatment (hydrophobicity-imparting treatment), thus decreasing the adsorption speed of nitrate ion to provide a larger measured $C_N$ value.

Accordingly, the hydrotalcite-type compound before the stearic acid treatment was subjected to the $C_N$ measurement, whereby a $C_N$ of 3.72 mg/l was obtained.

As described above, the hydrotalcite-type compound surface treated with stearic acid also corresponds to a nitrate ion adsorbent described hereinabove.

Then, on an aluminum sheet, the paint used for the surface layer (second coating layer) was applied by wet-coating and dried to obtain a 20 $\mu$m-thick film, which was subjected to measurement of a volume resistivity (Rv) in the above-described manner.

The resultant Rv for the film (surface layer) was $5\times10^{15}$ ohm.cm.

Figure 1:
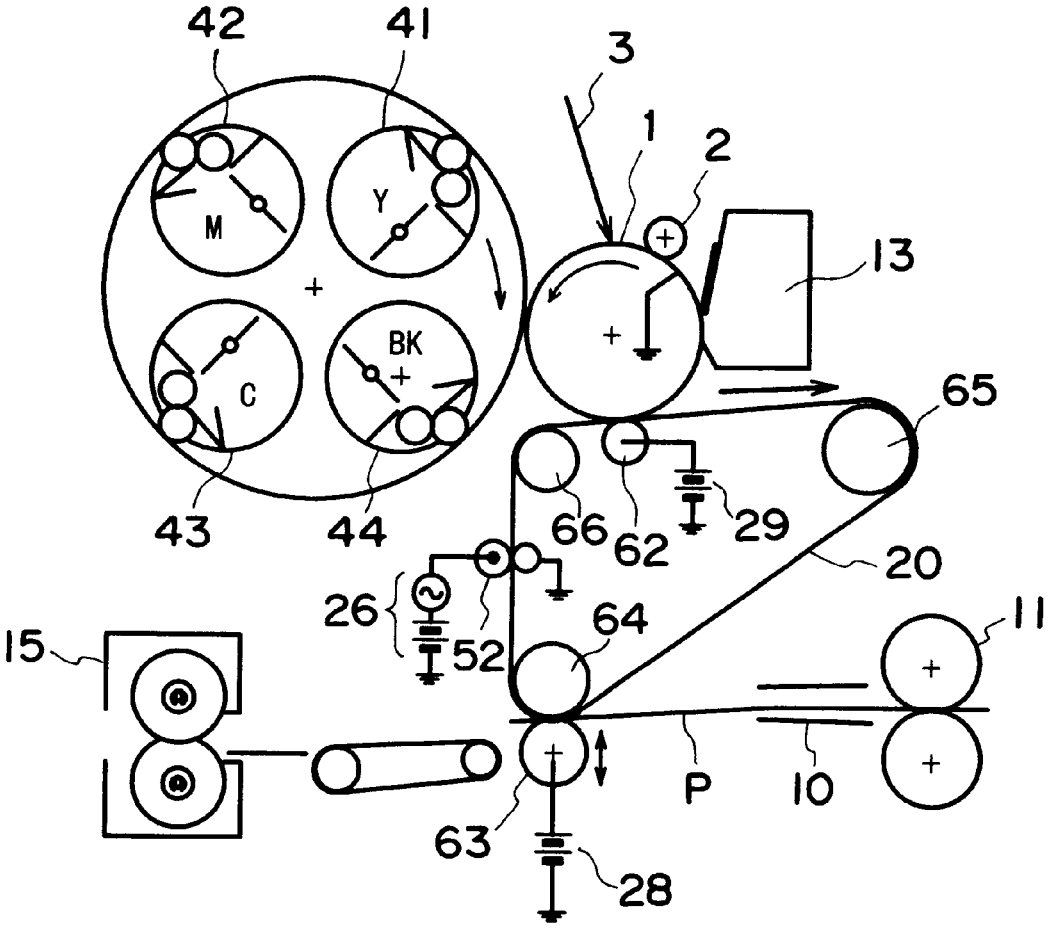
FIG. 1 is a schematic illustration of an image forming apparatus including an intermediate transfer member according to the present invention.

The above-prepared intermediate transfer member (according to the present invention) was incorporated in a full-color electrophotographic (image forming) apparatus (using a concurrent primary transfer-cleaning scheme) as shown in FIG. 1 and subjected to a successive image formation on 5000 sheets to evaluate an image quality (initial stage), a secondary transfer efficiency (initial stage), a hollow dropout image, a scattering of toner particles, and a volume resistivity (Rv) (measured in the above-described manner).

The results are shown in Table 3 appearing hereinafter.

The image forming conditions were as follows.

Environment: 23±1° C., 55±10% (RH)

Photosensitive member: OPC photosensitive drum

Surface potential at non-image (dark) part of photosensitive member: −550 volts

Surface potential of image (light) part of photosensitive member: −150 volts

Primary transfer (bias) voltage (for 1st color): +100 volts

Primary transfer voltage (for 2nd color): +650 volts

Primary transfer voltage (for 3rd color): +750 volts

Primary transfer voltage (for 4th color): +750 volts

Secondary transfer current: 12 $\mu$A (constant-current control)

Toner weight after primary transfer (on the intermediate transfer member):

0.7 mg/$cm^2$ (yellow, magenta, cyan)

0.8 mg/$cm^2$ (black)

Transfer residual toner charging member: rubber roller (electrical resistance: $10^6$ ohm)

Applied voltage to transfer residual toner charging member:

a DC (direct-current) of +100 volts superposed with a sine wave AC (alternating current) of frequency=2000 Hz and peak-to-peak voltage=3000 volts.

EXAMPLE 2

An intermediate transfer belt was prepared and evaluated in the same manner as in Example 1 except that the surface treatment with stearic acid (for the hydrotalcite-type compound) was not conducted.

The resultant adsorbent showed an attached amount and an attached state similar to those in Example 1.

The results are shown in Table 3.

EXAMPLE 3

A polycarbonate resin and carbon black were blended and subjected to inflation to prepare a 150 $\mu$m-thick seamless resin belt of 247 mm in width and 440 mm in outer peripheral length, which had an Rv of $1\times10^8$ ohm.cm.

An adsorbent (a hydrotalcite-type compound ("Ad-2"): $Mg_{0.8}Al_{0.2}(OH)_2(CO_3)_{0.1}\cdot0.61H_2O$) was attached onto the resin belt surface by electrostatic painting to prepare an intermediate transfer belt according to the present invention.

The adsorbent had an attached amount of 10 mg/1000 $cm^2$, a $C_N$ of 7.00 mg/l, and an $S_{BET}$ of 14 $m^2$/g, and showed an attached state as shown in FIG. 4.

The (evaluation) results are shown in Table 3.

EXAMPLE 4

An intermediate transfer belt was prepared and evaluated in the same manner as in Example 1 except that the adsorbent was attached onto the intermediate transfer belt surface in the following manner instead of the electrostatic painting.

A sponge roller was covered with the powdery adsorbent (the same as in Example 1) and then was rotated. The rotating sponge roller was attached or pressed against the rotating intermediate transfer belt, thus attaching a prescribed amount of the adsorbent onto the surface of the intermediate transfer member.

The thus prepared intermediate transfer member showed an attached amount of 40 mg/1000 $cm^2$ (as obtained from a change in weight before and after the attaching operation) and an attached state as shown in FIG. 4.

The results are shown in Table 3.

EXAMPLE 5

A hydrin rubber compound was wound about a 5 mm-thick aluminum cylinder (width=305 mm), followed by vulcanization and grinding to form a 3 mm-thick elastic (hydrin rubber layer) of 186 mm in outer peripheral length.

On the elastic layer, a polycarbonate-polyurethane paint was sprayed and thereto, in a wet film state of the paint, a powder adsorbent ("Ad-3") ($Mg_{0.68}Al_{0.32}O_{0.16}$; Dw=0.7 $\mu$m, $C_N$=3.12 mg/l, $S_{BET}$=155 $m^2$/g) was attached by electrostatic painting, followed by hot-drying at 130° C. at 1 hour to form a 20 $\mu$m-thick coating layer in which the adsorbent was partially embedded as shown in FIG. 5.

The coating layer had an Rv of $6\times10^{12}$ ohm.cm.

The thus-prepared intermediate transfer member (drum) according to the present invention showed an attached amount of the adsorbent of 10 mg/1000 $cm^2$.

Figure 16:
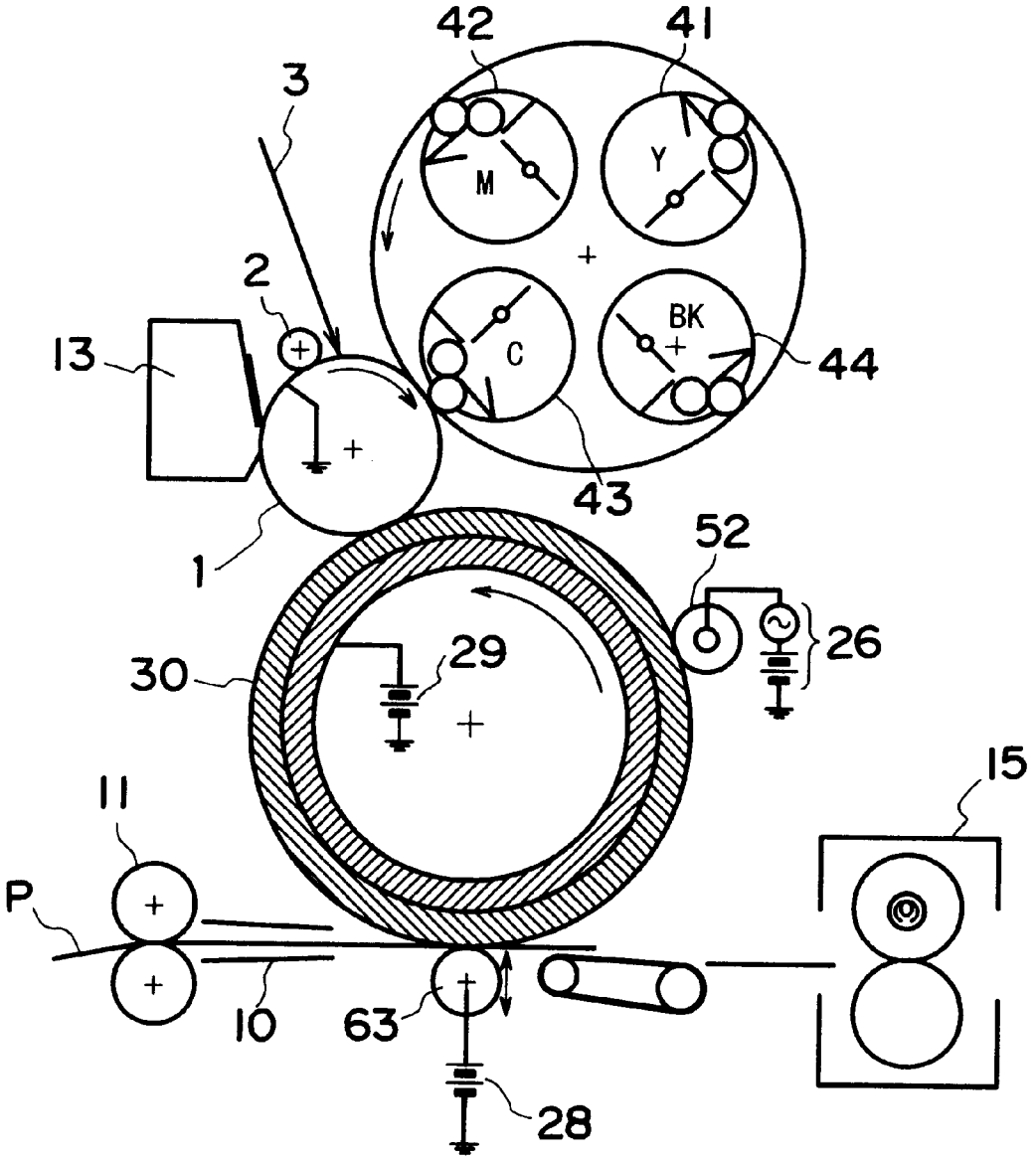
FIGS. 16 and 20 are schematic illustrations of image forming apparatus using an intermediate transfer member of a roller-type and that provided with adsorbent application means, respectively, according to the present invention.

The above-prepared intermediate transfer roller (according to the present invention) was incorporated in a full-color electrophotographic (image forming) apparatus (using a concurrent primary transfer-cleaning scheme) as shown in FIG. 16 (wherein the apparatus had the same structure as that of FIG. 1 except for an intermediate transfer drum 30) and subjected to a successive image formation on 5000 sheets to evaluate an image quality, a secondary transfer efficiency, a hollow dropout image and a scattering of toner particles similarly as in Example 1.

The results are shown in Table 3 appearing hereinafter.

The image forming conditions were as follows.

Environment: 23±1° C., 55±10% (RH)

Photosensitive member: OPC photosensitive drum

Surface potential at non-image (dark) part of photosensitive member: −550 volts

Surface potential of image (light) part of photosensitive member: −150 volts

Primary transfer (bias) voltage (for 1st color): +100 volts

Primary transfer voltage (for 2nd color): +200 volts

Primary transfer voltage (for 3rd color): +300 volts

Primary transfer voltage (for 4th color): +500 volts

Secondary transfer current: 20 $\mu$A (constant-current control)

Toner weight after primary transfer (on the intermediate transfer member):
0.7 mg/cm$^2$ (yellow, magenta, cyan)
0.8 mg/cm$^2$ (black)

Transfer residual toner charging member: rubber roller (electrical resistance: $10^6$ ohm)

Applied voltage to transfer residual toner charging member:
a DC (direct-current) of +100 volts superposed with a sine wave AC (alternating current) of frequency=1500 Hz and peak-to-peak voltage=4000 volts.

EXAMPLES 6–9

Intermediate transfer belts were prepared and evaluated in the same manner as in Example 4 except that the adsorbent was changed to those shown in Table 1 below, respectively.

All the adsorbents showed an attached amount of 40 mg/1000 cm$^2$ and an attached state as shown in FIG. 4.

The (evaluation) results are shown in Table 3 (appearing hereinafter).

TABLE 1

| Ex. No. | Adsorbent | $S_{BET}$ (m$^2$/g) | Dw ($\mu$m) | $C_N$ (mg/l) |
|---|---|---|---|---|
| 6 | $Mg_{0.5}Zn_{0.25}Al_{0.25}(OH)_2(CO_3)_{0.125} \cdot 0.3H_2O$ ("Ad-4") | 12 | 0.55 | 5.00 |
| 7 | $LiAl_2(OH)_6(PHO_2)_{0.5} \cdot 0.57H_2O$ ("Ad-5") | 9 | 0.6 | 2.50 |
| 8 | Anion-exchange resin* ("Ad-6") | 100 | 4 | 13.00 |
| 9 | $Mg_{0.85}Al_{0.15}(OH)_2(CO_3)_{0.05}(HCOO)_{0.05} \cdot 0.2H_2O$ ("Ad-7") | 15 | 0.8 | 10.00 |

*: The anion-exchange resin comprised polystyrene crosslinked with divinylbenzene and having triethanol amine groups as terminal groups.

EXAMPLES 10–15

Intermediate transfer belts were prepared and evaluated in the same manner as in Example 4 except that the attached amount (40 mg/1000 cm$^2$) was changed to those shown in Table 2 below, respectively.

TABLE 2

| Ex. No. | Attached amount (mg/1000 cm$^2$) |
|---|---|
| 10 | 0.08 |
| 11 | 0.1 |
| 12 | 1 |
| 13 | 500 |
| 14 | 2000 |
| 15 | 2500 |

In all the examples (Ex. 10–15), the adsorbent used was attached onto the intermediate transfer belt surface as shown in FIG. 4.

In Example 10, the intermediate transfer belt failed to provide a sufficient scattering prevention effect due to a smaller attached amount (0.08 mg/1000 cm$^2$ ).

On the other hand, in Example 15 using a larger attached amount (2500 mg/1000 cm$^2$), it was difficult to uniformly attach the adsorbent onto the intermediate transfer belt surface, thus partially forming an agglomeration thereof. The agglomeration (of the adsorbent) was secondary-transferred onto paper, thus resulting in a protuberant fixed image. This phenomenon was also observed in Example 14 slightly but was not observed in Example 13 at all.

The other evaluation results are shown in Table 3.

EXAMPLE 16

Figure 22:
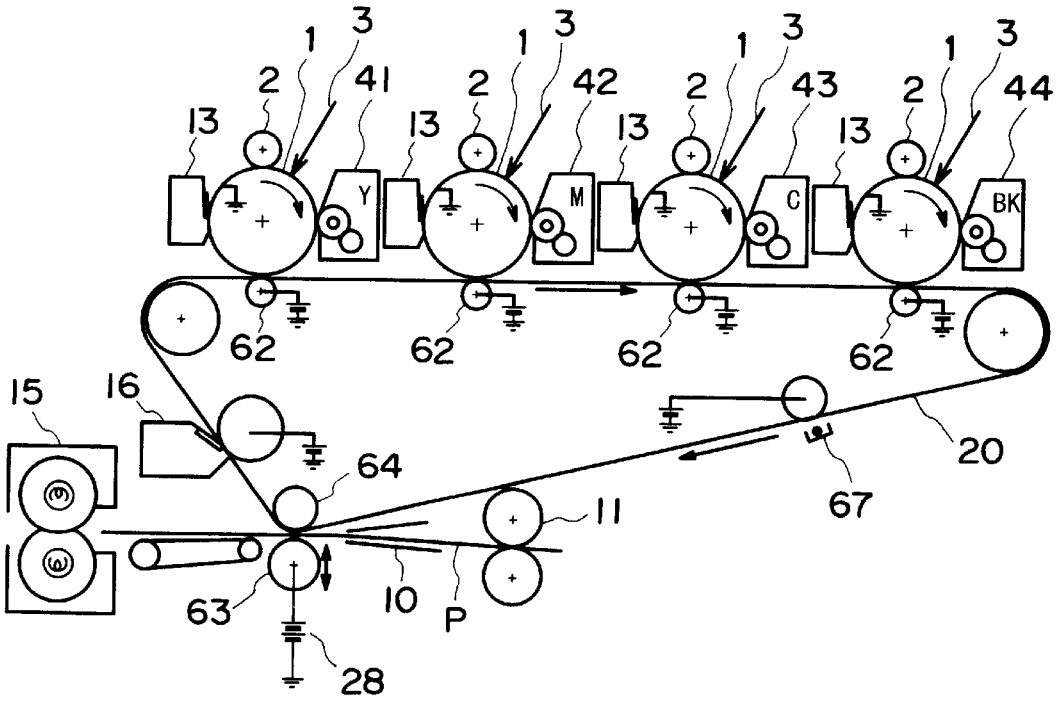
FIG. 22 is a schematic illustration of an image forming apparatus using another embodiment of an image transfer member of a belt-type, according to the present invention.

An intermediate transfer belt prepared in the same manner as in Example 3 except that the attached amount (10 mg/1000 m$^2$) of the adsorbent was changed to 20 mg/1000 cm$^2$ was incorporated in an image forming apparatus (using four photosensitive drums) as shown in FIG. 22 and subjected to image formation on 5000 sheets to effect evaluation in the same manner as in Example 1.

In the apparatus shown in FIG. 22, a corona charger 67 was supplied with a voltage comprising a DV voltage (−500 volts) superposed with an AC voltage (1 kHz, 5 kvolts (Vpp)) from a bias power supply (not shown).

The results are shown in Table 3.

Comparative Example 1

An intermediate transfer belt was prepared and evaluated in the same manner as in Example 1 except for omitting the adsorbent-attaching step (i.e., without using the adsorbent).

The results are shown in Table 3.

Comparative Example 2

An intermediate transfer drum was prepared and evaluated in the same manner as in Example 5 except for omitting the adsorbent-attaching step.

The results are shown in Table 3.

Comparative Example 3

An intermediate transfer belt was prepared and evaluated in the same manner as in Example 16 except for omitting the adsorbent-attaching step (i.e., with no adsorbent).

The results are shown in Table 3.

Comparative Example 4

An intermediate transfer belt was prepared and evaluated in the same manner as in Example 1 except that the adsorbent was not used but zinc stearate was attached to the intermediate transfer belt surface in an (attached) amount of 30 mg/1000 cm$^2$.

As a result of the evaluation, the secondary transfer efficiency (92%) was comparable to that (95%) of Example 1 but the scattering prevention effect in the successive image formation (on 3000 and 5000 sheets) was not attained.

The results are shown in Table 3 below.

TABLE 3

| Ex. No. | *1 Adsorbent | CN *2 (mg/l) | Image *3 Failure | Secondary *4 Transfer Efficiency (%) | Hollow Dropout *5 | Toner scattering *6 Initial | 3000 sheets | 5000 sheets | RV (ohm · cm) Initial | 5000 sheets |
|---|---|---|---|---|---|---|---|---|---|---|
| Ex. 1 | ST-Ad-1 | 3.72 (13.1) | Not Occurred | 95 | Not Occurred | A | A | A–B | $1 \times 10^{14}$ | $5 \times 10^{12}$ |
| 2 | Ad-1 | 3.72 | " | 96 | " | A | A | A–B | " | " |
| 3 | Ad-2 | 7.00 | " | 94 | " | A | A–B | A–B | $1 \times 10^{8}$ | $3 \times 10^{7}$ |
| 4 | ST-Ad-1 | 3.72 (13.1) | " | 93 | " | A | A | A | $1 \times 10^{14}$ | $5 \times 10^{13}$ |
| 5 | Ad-3 | 3.12 | " | 91 | " | A | A | A | $1 \times 10^{10}$ | $5 \times 10^{9}$ |
| 6 | Ad-4 | 5.00 | " | 92 | " | A | A | A–B | $1 \times 10^{14}$ | $5 \times 10^{12}$ |
| 7 | Ad-5 | 2.50 | " | 93 | " | A | A | A | " | $2 \times 10^{13}$ |
| 8 | Ad-6 | 13.00 | " | 95 | " | A | B | B | " | $5 \times 10^{11}$ |
| 9 | Ad-7 | 10.00 | " | 94 | " | A | A | B | " | $1 \times 10^{12}$ |
| 10 | ST-Ad-1 | 3.72 (13.1) | " | 80 | " | A | B | B | " | $5 \times 10^{11}$ |
| 11 | " | " | " | 85 | " | A | A–B | B | " | $1 \times 10^{12}$ |
| 12 | " | " | " | 92 | " | A | A–B | A–B | " | $3 \times 10^{12}$ |
| 13 | " | " | " | 93 | " | A | A | A | " | $2 \times 10^{13}$ |
| 14 | " | " | " | 95 | " | A | A | A | " | $5 \times 10^{13}$ |
| 15 | " | " | " | 92 | " | A | A | A | " | $5 \times 10^{13}$ |
| 16 | Ad-2 | 7.00 | " | 93 | " | A | A | A | $1 \times 10^{8}$ | $5 \times 10^{7}$ |
| Comp. Ex. 1 | — | — | Occurred | 70 | Occurred | A | B | C | $1 \times 10^{14}$ | $5 \times 10^{9}$ |
| 2 | — | — | Slightly Occurred | 82 | Not Occurred | A | A–B | B | $1 \times 10^{10}$ | $1 \times 10^{7}$ |
| 3 | — | — | Occurred | 76 | Occurred | A | A–B | B | $1 \times 10^{8}$ | $1 \times 10^{6}$ |
| 4 | — | — | Not Occurred | 92 | Not Occurred | A | B | C | $1 \times 10^{14}$ | $5 \times 10^{9}$ |

(Notes for Table 3)

*1: The respective adsorbed used were represented by abbreviations. "ST-" means that the adsorbent was surface treated with stearic acid.

*2: The values in parentheses were those measured after the surface (hydrophobicity-imparting) treatment.

*3: The image failure was evaluated as to whether the defective image due to cleaning failure of the intermediate transfer member occurred or not at an initial stage.

*4: The secondary transfer efficiency defined below was measured with respect to the cyan toner at an initial stage of copying operation.

Secondary transfer efficiency (%) = [(Image density on the paper)/(Residual image density on the intermediate transfer member + Image density on the paper)] × 100.

*5: The hollow dropout image (as shown in FIG. 6) was evaluated as to whether it occurred or not.

*6: The scattering of toner particles was evaluated based on a degree thereof at a portion where the magnet toner and the cyan toner overlapped each other by eye observation.

A: No or substantially no scattering was observed.

A–B: The scattering slight occurred.

B: The scattering somewhat occurred.

C: The clear scattering occurred.

EXAMPLE 17

An intermediate transfer member was prepared in the same manner as in Example 1 except that the adsorbent-attaching step was omitted (i.e., the intermediate transfer member surface was provided with no adsorbent at this stage), and then was incorporated in a full-color electrophotographic apparatus as shown in FIG. 17.

The apparatus shown in FIG. 17 included an adsorbent application means 70 comprising a roller-shaped application brush 71 and a roller-shaped adsorbent 25 disposed in contact with the brush 71. The brush 71 was comprised of rayon fibers (length=2 mm, size=6 D (derriere), density= $1.5 \times 10^4$ (fibers)/cm$^2$). The adsorbent 25 was prepared by melt-blending an adsorbent identical to that ("ST-Ad-1") of Example 1 and zinc stearate (10/1 by weight) ("ST-Ad-1/ZS"), followed by cooling to be solidified and formed into a roller shape.

The (roller-shaped) adsorbent 25 was gradually scraped by rotation of the brush 71 and then was applied (transferred) to a transfer residual toner charging member 52 which was comprised of a rubber roller having an electrical resistance of $10^6$ ohm and ordinarily disposed away from the intermediate transfer belt 20 (prepared above).

The (transfer residual toner) charging member 52 was abutted against the intermediate transfer belt 20 and supplied with a DC voltage of +100 V superposed with a sine wave AC voltage of 2000 Hz and 3000 V (peak-to-peak voltage) while a secondary-transfer residual toner passed at a nip portion between the charging member 52 and the intermediate transfer belt 20.

As a result, the (secondary transfer) residual toner was positively charged and transferred onto the photosensitive drum 1 to effect cleaning thereof.

In this example, the cleaning step was performed simultaneously with a primary transfer step for a subsequent image (i.e., the concurrent primary transfer-cleaning scheme).

When the charging member 52 was abutted against the intermediate transfer belt 20, a part of the adsorbent 25 attached onto the charging member 52 surface was transferred onto the intermediate transfer belt 20 surface, thus supplying the adsorbent 25 from the application brush 71 to the intermediate transfer belt 20 via the charging member 52.

The adsorbent 25 left on the charging member 25 may also be considered to contribute to the toner scattering prevention by adsorbing nitrate ion during the contact with the intermediate transfer belt 20.

The above-prepared intermediate transfer belt 20 incorporated in the apparatus (FIG. 17) was then subjected to a successive image formation on 10,000 sheets (A4-sized) under the same image forming conditions as in Example 1 and evaluated in the same manner as in Example 1.

The results are shown in Table 4 appearing hereinbelow.

In this example, the intermediate transfer belt showed a high secondary transfer efficiency of 95% which was comparable to that (95%) obtained in Example 18 (appearing below) employing the same adsorbent as in this example except for using no stearic acid (as the surface-treating agent). Accordingly, such a higher secondary transfer efficiency may be attributable to the hydrotalcite-type compound ("Ad-1") per se, irrespective of the lubricating and/or releasing effect of stearic acid.

After the successive image formation (10,000 sheets), the roller-shaped adsorbent 25 was weighed, whereby the adsorbent 25 was found to decrease in its weight by 10 g through the successive image formation. Accordingly, in this example, an amount (supply amount) of the adsorbent 25 supplied to the intermediate transfer belt 20 was 1 g/1000 sheets.

According to this example, the adsorbent 25 was continually supplied or transferred onto the intermediate transfer belt 20 (via the charging roller 52), thus more effectively maintaining the toner particle scattering prevention effect when compared with the case of Example 1.

EXAMPLE 18

An intermediate transfer belt was prepared and evaluated in the same manner as in Example 17 except that the adsorbent 25 had not been surface-treated with stearic acid ("Ad-1/ZS").

The adsorbent 25 used in this example was used in a supply amount of 1 g/1000 sheets similarly as in Example 17.

The results are shown in Table 4.

EXAMPLE 19

An intermediate transfer belt was prepared and evaluated in the same manner as in Example 17 except that the electrophotographic apparatus (FIG. 17) was changed to a full-color electrophotographic apparatus as shown in FIG. 18 employing an application means 80 and that the adsorbent 25 did not contain zinc stearate ("ST-Ad-1").

Referring to FIG. 18, the application means 80 was formed in a unit or cartridge detachably mountable to the apparatus and included an application roller 81 contactable to the intermediate transfer belt 20 and comprising a metal sleeve having a surface roughness Ra of 0.1–1 $\mu$m (as measured according to JIS-B0601). The application roller 81 was covered with cylindrical resin caps of 100–800 $\mu$m in thickness at both end portions thereof, thus ensuring a prescribed gap between the application roller 81 and the intermediate transfer belt 20 by abutting the caps to against the intermediate transfer belt 20.

In the application means 80, the adsorbent 25 was supplied from a sponge roller 83 of urethane foam to the application roller 81 while being regulated in its amount by a regulation blade 82. The adsorbent 25 used in this example was positively chargeable, so that the adsorbent 25 was electrically transferred (applied) onto the surface of the intermediate transfer belt 2 when the application roller 81 was supplied with a voltage comprising an AC voltage superposed with a positive DC voltage from a bias (voltage) power supply (not shown).

In this example, an supply amount of the adsorbent 25 was 0.9 g/1000 sheets.

The results are shown in Table 4.

EXAMPLE 20

An intermediate transfer belt was prepared and evaluated in the same manner as in Example 17 except that the electrophotographic apparatus (FIG. 17) was changed to a full-color electrophotographic apparatus as shown in FIG. 19 employing an application means employing an application means and the adsorbent ("ST-Ad-1/ZS") was changed to an adsorbent ("Ad-2") identical to that used in Example 3 but being used in a powdery form.

Referring to FIG. 19, a cleaning device 16 for the intermediate transfer belt 20 had the same structure as a cleaning device 13 for a photosensitive drum 1, thus having an urethane-made blade by which residual toner particles remaining after secondary transfer were removed to effect cleaning of the intermediate transfer belt 20.

The application means included an application brush 71 (the same as in Example 1) and an urethane-made application blade 101. The cleaning device 16, the application brush 71 and the application blade 101 were ordinarily disposed apart from the intermediate transfer member 20 at respective positioned immediately before the start of the secondary transfer. When the intermediate transfer member 20 was rotated by almost one-circumference length from the positions, the above members 16, 71 and 101 were detached again from the intermediate transfer member 20.

During the contact of the intermediate transfer belt 20 with the cleaning device 16, the application brush 71 and the application blade 101, the adsorbent 25 was supplied (applied) onto the intermediate transfer belt surface cleaned by the cleaning device 16.

In this example, the adsorbent 25 wa used in supply amount of 1.2 g/1000 sheets.

The results are shown in Table 4.

EXAMPLE 21

An intermediate transfer belt prepared in the same manner as in Example 4 (using the adsorbent (ST-Ad-1)) was incorporated in a full-color electrophotographic apparatus as shown in FIG. 17, followed by evaluation in the same manner as in Example 17.

In this example, the adsorbent 25 was supplied in a supply amount of 1 g/1000 sheets form the application means 70.

The results are shown in Table 4.

According to this example, the adsorbent was used in a total amount (attached amount and supply amount larger than Example 17 (only the supply amount) since the intermediate transfer belt 20 was provided with the adsorbent in advance, thus inactivating a larger amount of nitrate ion to more effectively suppress the toner particle scattering.

EXAMPLE 22

Figure 20:
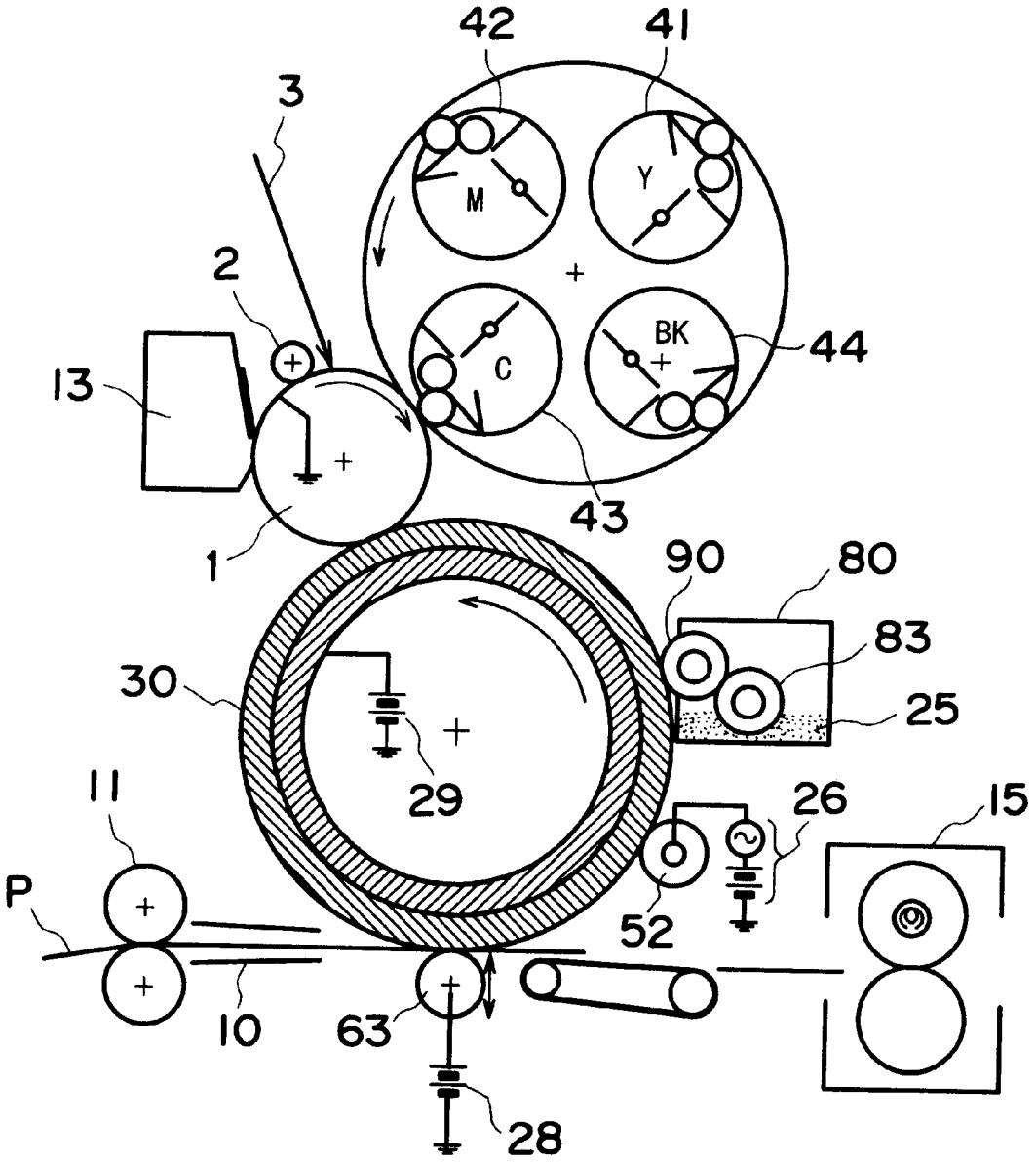

An intermediate transfer drum (intermediate transfer member) was prepared in the same manner as in Example 5 except that the adsorbent-attaching step was omitted and was incorporated in a full-color electrophotographic apparatus (employing the concurrent primary transfer-cleaning scheme) as shown in FIG. 20.

The apparatus shown in FIG. 20 included an adsorbent application means 80 comprising a spiral application roller 90 (outer diameter 16 mm) as shown in FIG. 14. The application roller 90 (FIG. 14) included an urethane sponge 92 (width=3 mm, height (thickness)=4 mm, average foam diameter=150 $\mu$m) spirally wound about and bonded to a 12 mm-dia. core metal 91 at an angle θ of 45 deg.

In this example, the adsorbent 25 used was identical to that (Ad-3) of Example 5.

The spiral application roller 90 ordinarily disposed apart from the intermediate transfer member 20 was abutted against the intermediate transfer member 20 every 100 sheets of copying (printing) and then was again detached therefrom at the time where the intermediate transfer member 20 was rotated by one-circumference length based on the abutting position.

The spiral application roller 90 was rotated at a speed of 200 rpm, thus providing a circumferential component of the resultant surface-moving speed of ca. 168 mm/sec (=(4+12)×ρ×200/60). The intermediate transfer member 20 was controlled to have a surface-moving speed of 117 mm/sec., so that when the adsorbent 25 was supplied (applied) to the intermediate transfer member 20, a rubbing (frictional) force in a circumferential direction and an axis direction of the intermediate transfer member (drum) 20 was exerted between the urethane sponge 92 and the intermediate transfer member 20, thus allowing uniform supply (application) of the adsorbent 25. The supply amount of the adsorbent 25 was 0.5 g/1000 sheets.

In this example, the secondary transfer efficiency of the intermediate transfer drum 20 was measured after 100 sheets of image formation (after the first adsorbent supply) with respect to the cyan toner.

Other evaluations were performed in the same manner as in Example 17 under the same image forming conditions as in Example 5.

The results are shown in Table 4.

EXAMPLES 23–25

Intermediate transfer belts were prepared and evaluated in the same manner as in Example 17 except that the adsorbent (ST-Ad-1/ZS) was changed to those used in Example 6 (Ad-4), Example 7 (Ad-5), and Example 8 (Ad-6), respectively.

In all these examples (Examples 23–25), the supply amount of the adsorbent 25 was 1 g/1000 sheets.

EXAMPLE 26

A compound consisting of polyacrylate resin and carbon black was melt-blended (kneaded) and extruded from a cylindrical die (inflation method) to obtain a 150 $\mu$m-thick intermediate transfer belt 20 of 330 mm in width and 1100 mm in outer peripheral length, which showed an Rv of $2\times10^7$ ohm.cm.

The thus prepared intermediate transfer belt 20 was incorporated in a full-color electrophotographic apparatus using plural (four) photosensitive members 1 as shown in FIG. 21.

The apparatus (FIG. 21) included an application means having a structure identical to those used in Example 20 and containing an adsorbent 25 identical to that (Ad-7) of Example 9. The adsorbent 25 (Ad-7) was used in a supply amount of 1 g/1000 sheets.

A corona charger 67 was supplied with a superposed voltage comprising an AC voltage (1 kHz, 5 kvolts (Vpp)) and a DC voltage (−500 volts) from a bias power supply (not shown).

The intermediate transfer belt 20 was evaluated in the same manner as in Example 17.

The results are shown in Table 4.

EXAMPLES 27–32

Intermediate transfer belts were prepared and evaluated in the same manner as in Example 17 except that the supply amount (1 g/1000 sheets) was changed to those shown in Table 5 appearing hereinbelow, respectively.

In Example 27, the intermediate transfer belt failed to provide a sufficient scattering prevention effect due to a smaller supply amount (0.08 mg/1000 sheets).

On the other hand, in Example 32 using a larger supply amount (120 g/1000 sheets), it was difficult to uniformly supply (apply) the adsorbent onto the intermediate transfer belt surface, thus partially forming an agglomeration thereof. The agglomeration (of the adsorbent) was secondary-transferred onto paper, thus resulting in a protuberant fixed image. This phenomenon was also observed in Example 31 slightly but was not observed in Example 30 at all.

The other evaluation results are shown in Table 4.

Comparative Example 5

An intermediate transfer belt was prepared and evaluated in the same manner as in Example 26 except for using a full-color electrophotographic apparatus as shown in FIG. 22 (instead of that of FIG. 21) including no adsorbent application means.

The results are shown in Table 4.

Comparative Example 6

An intermediate transfer belt was prepared and evaluated in the same manner as in Example 17 except that the adsorbent 25 was changed to zinc stearate, which was used in a supply amount of 1 g/1000 sheets.

As a result of the evaluation, the secondary transfer efficiency (90%) was closer to that (95%) of Example 17 but the scattering prevention effect in the successive image formation (on 5000 to 10000 sheets) was not attained since zinc stearate was not an adsorbent.

The results are shown in Table 4 below.

TABLE 4

| Ex. No. | *1 Adsorbent | *2 CN (mg/l) | Image *3 Failure | Secondary *4 Transfer Efficiency (%) | Hollow Dropout *5 | Toner scattering *6 Initial | 5000 sheets | 8000 sheets | $10^4$ sheets | RV (ohm · cm) Initial | $10^4$ sheets |
|---|---|---|---|---|---|---|---|---|---|---|---|
| Ex. 17 | ST-Ad-1/ZS | 3.72 (13.1) | Not Occurred | 95 | Not Occurred | A | A | A | A–B | $1 \times 10^{14}$ | $5 \times 10^{12}$ |
| 18 | Ad-1/ZS | 3.72 | " | 95 | " | A | A | A | A–B | " | " |
| 19 | ST-Ad-1 | 3.72 (13.1) | " | 94 | " | A | A | A | A–B | " | " |
| 20 | Ad-2 | 7.00 | " | 92 | " | A | A | A–B | B | " | $1 \times 10^2$ |
| 21 | ST-Ad-1/ZS | 3.72 (13.1) | " | 96 | " | A | A | A | A | " | $2 \times 10^{13}$ |
| 22 | Ad-3 | 3.12 | " | 93 | " | A | A | A | A | $1 \times 10^{10}$ | $5 \times 10^9$ |
| 23 | Ad-4 | 5.00 | " | 92 | " | A | A | A–B | A–B | $1 \times 10^{14}$ | $5 \times 10^{12}$ |
| 24 | Ad-5 | 2.50 | " | 91 | " | A | A | A | A | " | $1 \times 10^{13}$ |
| 25 | Ad-6 | 13.00 | " | 93 | " | A | A–B | B | B | " | $5 \times 10^{11}$ |
| 26 | Ad-7 | 10.00 | " | 92 | " | A | A | B | B | $2 \times 10^7$ | $1 \times 10^7$ |
| 27 | ST-Ad-1/ZS | 3.72 (13.1) | Slightly Occurred | 84 | " | A | B | B | B | $1 \times 10^{14}$ | $2 \times 10^{11}$ |
| 28 | " | " | Not Occurred | 90 | " | A | A | B | B | " | $5 \times 10^{11}$ |
| 29 | " | " | " | 95 | " | A | A | A–B | A–B | " | $8 \times 10^{12}$ |
| 30 | " | " | " | 96 | " | A | A | A | A | " | $8 \times 10^{13}$ |
| 31 | " | " | " | 95 | " | A | A | A | A | " | $8 \times 10^{13}$ |
| 32 | " | " | " | 96 | " | A | A | A | A | " | $1 \times 10^{13}$ |
| Comp. Ex. 5 | — | — | Occurred | 80 | Occurred | A | A–B | B | B | $2 \times 10^7$ | $3 \times 10^5$ |
| 6 | — | — | Not Occurred | 90 | Not Occurred | A | C | C | C | $1 \times 10^{14}$ | $1 \times 10^9$ |

(Notes for Table 4)
*1: The respective adsorbed used were represented by abbreviations. "ST-" means that the adsorbent was surface treated with stearic acid. "ZS" means that zinc stearate was contained in the adsorbent.
*2: The values in parentheses were those measured after the surface (hydrophobicity-imparting) treatment.
*3: The image failure was evaluated as to whether the defective image due to cleaning failure of the intermediate transfer member occurred or not at an initial stage. In Example 17, the defective image was at a practically acceptable level.
*4: The secondary transfer efficiency defined below was measured with respect to the cyan toner at an initial stage (after 100 sheets for Example 22) of copying operation.
Secondary transfer efficiency (%) = [(Image density on the paper)/(Residual image density on the intermediate transfer member + Image density on the paper)] × 100.
*5: The hollow dropout image (as shown in FIG. 6) was evaluated as to whether it occurred or not.
*6: The scattering of toner particles was evaluated based on a degree thereof at a portion where the magnet toner and the cyan toner overlapped each other by eye observation.
A: No or substantially no scattering was observed.
A–B: The scattering slight occurred.
B: The scattering somewhat occurred.
C: The clear scattering occurred.

TABLE 5

| Ex. No. | Adsorbent supply amount |
|---|---|
| 27 | 0.08 mg/1000 sheets |
| 28 | 0.1 mg/1000 sheets |
| 29 | 10 mg/1000 sheets |
| 30 | 10 mg/1000 sheets |
| 31 | 100 g/1000 sheets |
| 32 | 120 g/1000 sheets |

What is claimed is:

1. An intermediate transfer member having a surface for receiving a toner image formed on a first image-bearing member and transferring the toner image onto a second image-bearing member, wherein the surface of the intermediate transfer member is coated with at least one of a nitrate ion adsorbent and a compound having a layer structure.

2. A member according to claim 1, wherein said compound having a layer structure is a hydrotalcite-type compound represented by the following formula (1):

$$M^{2+}_{(1-x)}M^{3+}_{x}(OH)_2A^{n-}_{(x/n)}.mH_2O \quad (1),$$

wherein $M^{2+}$ denotes a divalent metal ion; $M^{3+}$ denotes a trivalent metal ion; $A^{n-}$ denotes an anion having a valence of n; X denotes a molar fraction and $0<X\leqq 0.5$; and $m\geqq 0$.

3. A member according to claim 2, wherein $A^{n-}$ in the formula (1) provides a conjugate acid $HA^{(n-1)-}$ having a pKa of at least 3.

4. A member according to claim 3, wherein said hydrotalcite-type compound is represented by the following formula (2):

$$Mg_{(1-x)}Al_x(OH)_2(CO_3)_{x/2}.mH_2O \quad (2),$$

wherein $0<X\leqq 0.5$ and $m\geqq 0$.

5. A member according to claim 1, wherein said compound having a layer structure is a lithium aluminate-type compound represented by the following formula (3):

$$Li_{(1-x)}M^{2+}_{x}M^{3+}_{2}(OH)_6A^{n-}_{((1+x)/n)}.mH_2O \quad (3),$$

wherein $M^{2+}$ denotes a divalent metal ion, $M^{3+}$ denotes a trivalent metal ion, $A^{n-}$ denotes an anion having a valency of n where n is an integer of at least 1, X denotes a molar fraction, $0<X\leqq 0.5$ and $m\geqq 0$.

6. A member according to claim 5, wherein $A^{n-}$ in the formula (3) provides a conjugate acid $HA^{(n-1)-}$ having a pKa of at least 3.

7. A member according to claim 1, wherein said compound having a layer structure is represented by the following formula (4):

$$M^{2+}_{(1-x)}M^{3+}_{x}O_{(1+x/2)}\cdot mH_2O \quad (4),$$

wherein $M^{2+}$ denotes a divalent metal ion, $M^{3+}$ denotes a trivalent metal ion, X denotes a molar fraction, $0<X\leqq 0.5$, and $m\geqq 0$.

8. A member according to claim 1, wherein said compound having a layer structure is represented by the following formula (5):

$$Mg_{(1-x)}Al_xO_{(1+x/2)}\cdot mH_2O \quad (5),$$

wherein X denotes a molar fraction and $0<X\leqq 0.5$, and $m\geqq 0$.

9. A member according to claim 1, wherein each of said nitrate ion adsorbent and said compound having a layer structure is present at the surface of the member in an amount of 0.1 mg/1000 $cm^2$ to 2 g/1000 $cm^2$.

10. A member according to claim 1, wherein each of said nitrate ion adsorbent and said compound having a layer structure is a powder.

11. A member according to claim 10, wherein said powder has a weight-average particle size of 0.005–100 $\mu$m.

12. A member according to claim 1, wherein said member has a belt form.

13. An image forming apparatus, comprising:

a first image-bearing member, and an intermediate transfer member having a surface for receiving a toner image formed on the first image-bearing member and transferring the toner image onto a second image-bearing member, wherein the surface of the intermediate transfer member is coated with at least one of a nitrate ion adsorbent and a compound having a layer structure.

14. An apparatus according to claim 13, wherein said compound having a layer structure is a hydrotalcite-type compound represented by the following formula (1):

$$M^{2+}_{(1-x)}M^{3+}_{x}(OH)_2A^{n-}_{(x/n)}\cdot mH_2O \quad (1),$$

wherein $M^{2+}$ denotes a divalent metal ion; $M^{3+}$ denotes a trivalent metal ion; $A^{n-}$ denotes an anion having a valence of n; X denotes a molar fraction and $0<X\leqq 0.5$; and $m\geqq 0$.

15. An apparatus according to claim 14, wherein $A^{n-}$ in the formula (1) provides a conjugate acid $HA^{(n-1)-}$ having a pKa of at least 3.

16. An apparatus according to claim 15, wherein said hydrotalcite-type compound is represented by the following formula (2):

$$Mg_{(1-x)}Al_x(OH)_2(CO_3)_{x/2}\cdot mH_2O \quad (2),$$

wherein $0<X\leqq 0.5$ and $m\geqq 0$.

17. An apparatus according to claim 13, wherein said compound having a layer structure is a lithium aluminate-type compound represented by the following formula (3):

$$Li_{(1-x)}M^{2+}_{x}M^{3+}_{2}(OH)_6A^{n-}_{((1+x)/n)}\cdot mH_2O \quad (3),$$

wherein $M^{2+}$ denotes a divalent metal ion, $M^{3+}$ denotes a trivalent metal ion, $A^{n-}$ denotes an anion having a valency of n where n is an integer of at least 1, X denotes a molar fraction, $0<X\leqq 0.5$ and $m\geqq 0$.

18. An apparatus according to claim 17, wherein $A^{n-}$ in the formula (3) provides a conjugate acid $HA^{(n-1)-}$ having a pKa of at least 3.

19. An apparatus according to claim 13, wherein said compound having a layer structure is represented by the following formula (4):

$$M^{2+}_{(1-x)}M^{3+}_{x}O_{(1+x/2)}\cdot mH_2O \quad (4),$$

wherein $M^{2+}$ denotes a divalent metal ion, $M^{3+}$ denotes a trivalent metal ion, X denotes a molar fraction, $0<X\leqq 0.5$, and $m\geqq 0$.

20. An apparatus according to claim 13, wherein said compound having a layer structure is represented by the following formula (5):

$$Mg_{(1-x)}Al_xO_{(1+x/2)}\cdot mH_2O \quad (5),$$

wherein X denotes a molar fraction and $0<X\leqq 0.5$, and $m\geqq 0$.

21. An apparatus according to claim 13, wherein each of said nitrate ion adsorbent and said compound having a layer structure is present at the surface of the member in an amount of 0.1 mg/1000 $cm^2$ to 2 g/1000 $cm^2$.

22. An apparatus according to claim 13, wherein each of said nitrate ion adsorbent and said compound having a layer structure is a powder.

23. An apparatus according to claim 22, wherein said powder has a weight-average particle size of 0.005–100 $\mu$m.

24. An apparatus according to claim 13, wherein said member has a belt form.

25. An apparatus according to claim 13, which further comprises electrostatic cleaning means for said intermediate transfer member.

26. An apparatus according to claim 25, wherein said electrostatic cleaning means employs a concurrent primary transfer-cleaning scheme.

27. An image forming apparatus, comprising:

a first image-bearing member, and an intermediate transfer member for receiving a toner image formed on the first image-bearing member and transferring the toner image onto a second image-bearing member, and application means for supplying at least one of a nitrate ion adsorbent and a compound having a layer structure onto a surface of said intermediate transfer member.

28. An apparatus according to claim 27, wherein said compound having a layer structure is a hydrotalcite-type compound represented by the following formula (1):

$$M^{2+}_{(1-x)}M^{3+}_{x}(OH)_2A^{n-}_{(x/n)}\cdot mH_2O \quad (1),$$

wherein $M^{2+}$ denotes a divalent metal ion; $M^{3+}$ denotes a trivalent metal ion; $A^{n-}$ denotes an anion having a valence of n; X denotes a molar fraction and $0<X\leqq 0.5$; and $m\geqq 0$.

29. An apparatus according to claim 28, wherein $A^{n-}$ in the formula (1) provides a conjugate acid $HA^{(n-1)-}$ having a pKa of at least 3.

30. An apparatus according to claim 29, wherein said hydrotalcite-type compound is represented by the following formula (2):

$$Mg_{(1-x)}Al_x(OH)_2(CO_3)_{x/2}\cdot mH_2O \quad (2),$$

wherein $0<X\leqq 0.5$ and $m\geqq 0$.

31. An apparatus according to claim 27, wherein said compound having a layer structure is a lithium aluminate-type compound represented by the following formula (3):

$$Li_{(1-x)}M^{2+}_{x}M^{3+}_{2}(OH)_6A^{n-}_{((1+x)/n)}\cdot mH_2O \quad (3),$$

wherein $M^{2+}$ denotes a divalent metal ion, $M^{3+}$ denotes a trivalent metal ion, $A^{n-}$ denotes an anion having a valency of n where n is an integer of at least 1, X denotes a molar fraction, $0<X\leqq 0.5$ and $m\geqq 0$.

32. An apparatus according to claim 31, wherein $A^{n-}$ in the formula (3) provides a conjugate acid $HA^{(n-1)-}$ having a pKa of at least 3.

33. An apparatus according to claim 27, wherein said compound having a layer structure is represented by the following formula (4):

$$M^{2+}_{(1-x)}M^{3+}_{x}O_{(1+x/2)}\cdot mH_2O \quad (4),$$

wherein $M^{2+}$ denotes a divalent metal ion, $M^{3+}$ denotes a trivalent metal ion, X denotes a molar fraction, $0<X\leqq 0.5$, and $m\geqq 0$.

34. An apparatus according to claim 27, wherein said compound having a layer structure is represented by the following formula (5):

$$Mg_{(1-x)}Al_xO_{(1+x/2)}\cdot mH_2O \quad (5),$$

wherein X denotes a molar fraction and $0<X\leqq 0.5$, and $m\geqq 0$.

35. An apparatus according to claim 27, wherein each of said nitrate ion adsorbent and said compound having a layer structure is present at the surface of the member in an amount of 0.1 mg/1000 $cm^2$ to 2 g/1000 $cm^2$.

36. An apparatus according to claim 27, wherein each of said nitrate ion adsorbent and said compound having a layer structure is a powder.

37. An apparatus according to claim 36, wherein said powder has a weight-average particle size of 0.005–100 $\mu$m.

38. An apparatus according to claim 27, wherein said member has a belt form.

39. An apparatus according to claim 27, which further comprises electrostatic cleaning means for said intermediate transfer member.

40. An apparatus according to claim 39, wherein said electrostatic cleaning means employs a concurrent primary transfer-cleaning scheme.

41. An apparatus according to claim 27, wherein said application means supplies at least one of an nitrate ion adsorbent and a compound having a layer structure onto a surface of the intermediate transfer member in an amount of 0.1 mg to 100 g per 1000 sheets of A4-sized images.

* * * * *

UNITED STATES PATENT AND TRADEMARK OFFICE

CERTIFICATE OF CORRECTION

PATENT NO. : 6,094,556 
DATED : July 25, 2000
INVENTOR(S) : Atsushi Tanaka et al.

It is certified that error appears in the above-identified patent and that said Letters Patent is hereby corrected as shown below:

Column 1,
Line 16, “is” should read -- is more --;
Line 36, “therefore” should read -- and therefore --.

Column 3,
Line 23, “image-baring” should read -- image-bearing --.

Column 5,
Line 34, “preferably” should read -- may preferably --.

Column 6,
Line 7, “suppression” should read -- suppressing --;
Line 48, “$\rightarrow M^{2+}{}_{(1-x)}M^{3}+$” should read -- $\rightarrow M^{2+}{}_{(1-x)}M^{3+}$ --.

Column 7,
Line 20, “last” should read -- least --;
Line 28, “$HA_{(n-1)-}$” should read -- $HA^{(n-1)-}$.

Column 8,
Line 22, “ha” should read -- has --.

Column 9,
Line 1, “sufficient” should read -- sufficiently --;
Line 34, “$M^{2+}{}_{(1-x)}M^{3}+{}_{x}O_{(1+x/2)} \cdot mH_2O$” should read -- $M^{2+}{}_{(1-x)}M^{3+}$ x $O_{(1+x/2)} \cdot mH_2O$ --;
Line 40, “hydrotalicite-type” should read -- hydrotalcite-type --;
Line 57, “ia” should read -- a --.

Column 10,
Line 3, “qf” should read -- of --;
Line 50, “sufficient” should read -- sufficiently --.

Column 11,
Line 27, “is” should read -- is a --;
Line 42, “comprises” should read -- comprise --;
Line 49, “lowing” should read -- allowing --;
Line 58, “secondary.” should read -- secondary --;
Line 67, “subjected” should read -- subjecting --.

UNITED STATES PATENT AND TRADEMARK OFFICE

CERTIFICATE OF CORRECTION

PATENT NO. : 6,094,556
DATED : July 25, 2000
INVENTOR(S) : Atsushi Tanaka et al.

It is certified that error appears in the above-identified patent and that said Letters Patent is hereby corrected as shown below:

Column 12,
Line 35, “is” should be deleted;
Line 60, “of” should read -- of the --.

Column 15,
Line 61, “(or” should read -- or --.

Column 17,
Line 43, “prevent” should read -- present --.

Column 25,
Table 3, under (Notes for Table 3) “slight” should read -- slightly --.

Column 27,
Line 66, “to” should be deleted.

Column 28,
Line 35, “at respective” should read -- and respectively --;
Line 47, “wa” should read -- was --;
Line 59, “form” should read -- from --.

UNITED STATES PATENT AND TRADEMARK OFFICE

CERTIFICATE OF CORRECTION

PATENT NO. : 6,094,556
DATED : July 25, 2000
INVENTOR(S) : Atsushi Tanaka et al.

It is certified that error appears in the above-identified patent and that said Letters Patent is hereby corrected as shown below:

Column 31,

| | | | |
|---|---|---|---|
| Table 4, " | 20 | Ad-2 | 7.00 " |
| | | | 3.72 |
| | 21 | ST-Ad-1/25 | (13.1) |
| | | should read | |
| -- | 20 | Ad-2 | 7.00 -- |
| | 21 | ST-Ad-1/25 | 3.72 |
| | | | (13.1); |

Table 4, under (Notes for Table 4) "slight" should read -- slightly --.

Signed and Sealed this

Twelfth Day of October, 2004

JON W. DUDAS
*Director of the United States Patent and Trademark Office*